US010976085B2

(12) United States Patent
Onaka et al.

(10) Patent No.: US 10,976,085 B2
(45) Date of Patent: Apr. 13, 2021

(54) AIR-CONDITIONING APPARATUS

(71) Applicant: Mitsubishi Electric Corporation, Chiyoda-ku (JP)

(72) Inventors: Yoji Onaka, Chiyoda-ku (JP); Takashi Matsumoto, Chiyoda-ku (JP); Hiroyuki Okano, Chiyoda-ku (JP); Eito Saito, Chiyoda-ku (JP); Hirofumi Koge, Chiyoda-ku (JP); Osamu Morimoto, Chiyoda-ku (JP); Hiroki Murakami, Chiyoda-ku (JP); Hiroaki Nakamune, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 670 days.

(21) Appl. No.: 15/310,875

(22) PCT Filed: Mar. 25, 2015

(86) PCT No.: PCT/JP2015/059095
§ 371 (c)(1),
(2) Date: Nov. 14, 2016

(87) PCT Pub. No.: WO2015/178097
PCT Pub. Date: Nov. 26, 2015

(65) Prior Publication Data

US 2017/0082332 A1 Mar. 23, 2017

(30) Foreign Application Priority Data

May 19, 2014 (JP) ..... JP2014-102954

(51) Int. Cl.
*F25B 41/20* (2021.01)
*F25B 39/02* (2006.01)
(Continued)

(52) U.S. Cl.
CPC ..... *F25B 41/20* (2021.01); *F25B 1/00* (2013.01); *F25B 13/00* (2013.01); *F25B 39/00* (2013.01);
(Continued)

(58) Field of Classification Search
CPC ..... F25B 41/04; F25B 41/003; F25B 41/043; F25B 13/00; F25B 49/02; F25B 39/028;
(Continued)

(56) References Cited

U.S. PATENT DOCUMENTS 5,743,111 A * 4/1998 Sasaki ..... F25B 13/00 165/110
5,987,907 A * 11/1999 Morimoto ..... F25B 9/006 62/212
(Continued)

FOREIGN PATENT DOCUMENTS

JP 7-318276 A 12/1995
JP 10-267469 A 10/1998
(Continued)

OTHER PUBLICATIONS

International Search Report dated Jun. 9, 2015 filed PCT/JP2015/059095 filed Mar. 25, 2015.
(Continued)

*Primary Examiner* — Jianying C Atkisson
*Assistant Examiner* — Miguel A Diaz
(74) *Attorney, Agent, or Firm* — Xsensus LLP

(57) ABSTRACT

In an air-conditioning apparatus in which air sucked into a casing of an outdoor unit by a fan is discharged from an upper portion of the casing, each of liquid header portions is configured to be connected with each of heat transfer tubes of a plurality of divided regions formed by dividing the outdoor heat exchangers in an up and down direction. Further, a shunt is configured to supply two-phase refriger-
(Continued)

ant, in which quality is adjusted by a gas-liquid separator, to each of the liquid header portions. To each of the liquid header portions, the shunt supplies the two-phase refrigerant of the amount corresponding to the air quantity of the divided region connected to each of the liquid header portions.

16 Claims, 19 Drawing Sheets

(51) Int. Cl.

| | |
|---|---|
| ***F25B 13/00*** | (2006.01) |
| ***F25B 39/00*** | (2006.01) |
| ***F25B 1/00*** | (2006.01) |
| ***F28D 1/047*** | (2006.01) |
| ***F25B 49/02*** | (2006.01) |

(52) U.S. Cl.
CPC ..... *F25B 39/02* (2013.01); *F25B 49/02* (2013.01); *F28D 1/047* (2013.01); *F25B 39/028* (2013.01); *F25B 2313/0233* (2013.01); *F25B 2313/0294* (2013.01); *F25B 2400/23* (2013.01); *F25B 2500/09* (2013.01); *F25B 2600/2501* (2013.01); *F25B 2600/2511* (2013.01)

(58) Field of Classification Search
CPC ..... F25B 2400/23; F25B 2600/2501; F25B 39/00; F25B 39/02; F25B 2400/0403; F25B 2400/0409; F25B 2400/0415; F25B 2400/13; F25B 2400/16; F25B 2600/25; F25B 2600/2523; F25B 2600/2509; F25B 43/006; F25B 2339/044; F25B 2339/0442; F25B 2339/0444; F25B 2339/0446
See application file for complete search history.

(56) References Cited

U.S. PATENT DOCUMENTS

| | | | | |
|---|---|---|---|---|
| 6,381,974 | B1 * | 5/2002 | Hwang | F25B 13/00 165/286 |
| 8,387,411 | B2 * | 3/2013 | Fujimoto | F25B 1/10 62/505 |
| 8,567,203 | B2 * | 10/2013 | Jang | F25B 13/00 62/81 |
| 9,784,481 | B2 * | 10/2017 | Kawano | F25B 13/00 |
| 2008/0023563 | A1 * | 1/2008 | Tamura | F25B 13/00 236/67 |
| 2009/0007589 | A1 * | 1/2009 | Takegami | F25B 13/00 62/498 |
| 2010/0300141 | A1 * | 12/2010 | Fujimoto | F25B 1/10 62/498 |
| 2011/0314852 | A1 * | 12/2011 | Kinoshita | F25B 13/00 62/159 |
| 2012/0118533 | A1 * | 5/2012 | Jang | F25B 49/02 165/96 |
| 2013/0105118 | A1 * | 5/2013 | Hong | F25B 13/00 165/96 |
| 2013/0145785 | A1 * | 6/2013 | Nobuhiro | F25B 49/02 62/160 |
| 2013/0145791 | A1 | 6/2013 | Christensen | |
| 2013/0269380 | A1 * | 10/2013 | Oya | F25B 41/043 62/190 |
| 2014/0102131 | A1 * | 4/2014 | Okamoto | F25B 1/10 62/510 |
| 2014/0352343 | A1 | 12/2014 | Hinde et al. | |
| 2015/0047381 | A1 * | 2/2015 | Fujimoto | F25B 49/022 62/180 |
| 2016/0033179 | A1 * | 2/2016 | Kim | F25B 13/00 62/324.6 |
| 2016/0123645 | A1 * | 5/2016 | Kim | F25B 49/02 62/115 |
| 2016/0209084 | A1 * | 7/2016 | Kawano | F25B 13/00 |
| 2016/0238271 | A1 * | 8/2016 | Kimura | F25B 13/00 |
| 2016/0238285 | A1 * | 8/2016 | Kawano | F25B 13/00 |
| 2017/0067697 | A1 * | 3/2017 | Xue | F28F 9/0275 |
| 2019/0024951 | A1 * | 1/2019 | Nishiyama | F25B 13/00 |
| 2019/0170451 | A1 * | 6/2019 | Yokozeki | F24F 1/0059 |
| 2019/0195539 | A1 * | 6/2019 | Akaiwa | F25B 5/00 |

FOREIGN PATENT DOCUMENTS

| | | | | |
|---|---|---|---|---|
| JP | 2002-206890 | A | 7/2002 | |
| JP | 2007-327707 | A | 12/2007 | |
| JP | 2007327707 | A * | 12/2007 | F25F 39/00 |
| JP | 2010-047420 | A1 | 4/2010 | |
| JP | 2010-127601 | A | 6/2010 | |
| JP | 2010127601 | A * | 6/2010 | |
| JP | 2012-21679 | A | 2/2012 | |
| JP | 2012-193872 | A | 10/2012 | |
| KR | 101425043 | B1 * | 8/2014 | |
| WO | WO 2013001816 | A1 * | 1/2013 | F25B 1/10 |
| WO | WO 2013/078088 | A1 | 5/2013 | |
| WO | WO-2017068642 | A1 * | 4/2017 | F25B 43/00 |

OTHER PUBLICATIONS

Extended European Search Report dated Jan. 5, 2018 in European Patent Application No. 15796237.4, 8 pages.

* cited by examiner

AIR-CONDITIONING APPARATUS

TECHNICAL FIELD

The present invention relates to an air-conditioning apparatus.

BACKGROUND ART

Distribution of the wind speed (air quantity) of the air passing through a heat exchanger is generally not uniform but is distributed. For example, in the case of an air-conditioning apparatus in which the air, taken into the casing of an outdoor unit by an outdoor fan, exchanges heat in an outdoor heat exchanger and then the air is discharged from an upper portion of the casing, the wind speed in the outdoor heat exchanger is distributed in such a manner that the wind speed of the upper side increases and the wind speed in the lower side decreases. When the distribution of refrigerant supplied to the heat exchanger and the distribution of the wind speed (air quantity) do not match, the performance of the heat exchanger may not be drawn out. For example, in the case where the heat exchanger is an evaporator, the refrigerant cannot be evaporated completely at a portion of a heat transfer tube where air quantity passing through is small, so that the performance of the heat exchanger cannot be drawn out. To solve such a problem, as a conventional air-conditioning apparatus in which the air, taken into the casing of an outdoor unit by an outdoor fan, exchanges heat with an outdoor heat exchanger and then the air is discharged from an upper portion of the casing, one in which an outdoor heat exchanger is divided into a plurality of divided regions in an up and down direction, and for each divided region, two-phase refrigerant of the amount corresponding to the air quantity is supplied using a distributor, has been proposed (for example, see Patent Literature 1).

CITATION LIST

Patent Literature

Patent Literature 1: Japanese Unexamined Patent Application Publication No. 2010-127601

SUMMARY OF INVENTION

Technical Problem

In the air-conditioning apparatus described in Patent Literature 1, two-phase refrigerant, having flowed out of the expansion valve, is distributed to each divided region of the outdoor heat exchanger by a distributor. As such, in the divided region, as the refrigerant is equally distributed to the respective heat transfer tubes, there is a problem that the refrigerant cannot be distributed corresponding to the distribution of the wind speed in the divided region, so that the performance of the outdoor heat exchanger cannot be improved sufficiently.

The present invention has been made to solve such a problem. An object of the present invention is to achieve an air-conditioning apparatus that enables allocation of two-phase refrigerant according to the distribution of the wind speed in a divided region of an outdoor heat exchanger, and enables improvement of performance of the outdoor heat exchanger.

Solution to Problem

An air-conditioning apparatus, according to the present invention, includes a refrigeration cycle including an outdoor heat exchanger functioning as a compressor, a condenser, an expansion valve, or an evaporator, and a liquid header connected to a position that is a refrigerant inflow side of the outdoor heat exchanger when the outdoor heat exchanger functions as the evaporator; and an outdoor fan configured to supply air to the outdoor heat exchanger. The outdoor heat exchanger is provided to a casing of an outdoor unit such that heat transfer tubes are arranged in parallel in an up and down direction, and the air, sucked into the casing of the outdoor unit by the outdoor fan, is discharged from an upper portion of the casing after exchanging heat with the outdoor heat exchanger. The liquid header is divided into a plurality of liquid header portions in an up and down direction, and each of the liquid header portions is configured to be connected with each of the heat transfer tubes of the divided regions formed by dividing the outdoor heat exchanger in the up and down direction. The air-conditioning apparatus further includes a first gas-liquid separator configured to separate two-phase refrigerant, flowing out of the expansion valve, into gas refrigerant and liquid refrigerant; a bypass connecting the first gas-liquid separator and the suction side of the compressor, the bypass being configured to adjust an amount of the gas refrigerant, separated by the first gas-liquid separator, to be returned to the suction side of the compressor; and a shunt connecting the first gas-liquid separator and each of the liquid header portions, and supplying the two-phase refrigerant, in which quality is adjusted by the first gas-liquid separator, to each of the liquid header portions. The shunt is configured to supply, to each of the liquid header portions, the two-phase refrigerant of an amount corresponding to the air quantity of the divided region connected with each of the liquid header portions.

Advantageous Effects of Invention

In the air-conditioning apparatus of the present invention, two-phase refrigerant in which the quality is adjusted by the first gas-liquid separator is supplied to the shunt. As such, in the air-conditioning apparatus of the present invention, the speed of gas refrigerant flowing in each liquid header portion can be adjusted. Further, in the air-conditioning apparatus of the present invention, the shunt supplies, to each liquid header portion, the two-phase refrigerant of the amount corresponding to the divided region of the outdoor heat exchanger to which each liquid header portion is connected. As such, in the air-conditioning apparatus of the present invention, the amount of liquid refrigerant lifted upward by the gas refrigerant in the liquid header portion can be adjusted according to the wind speed distribution, and the refrigerant can be supplied to the divided region along the wind speed distribution, whereby it is possible to improve the performance of the outdoor heat exchanger sufficiently.

DESCRIPTION OF EMBODIMENTS

Hereinafter, embodiments of an air-conditioning apparatus according to the present invention will be described based on the drawings. It should be noted that the present invention is not limited to the embodiments described below.

Embodiment 1

Figure 1:
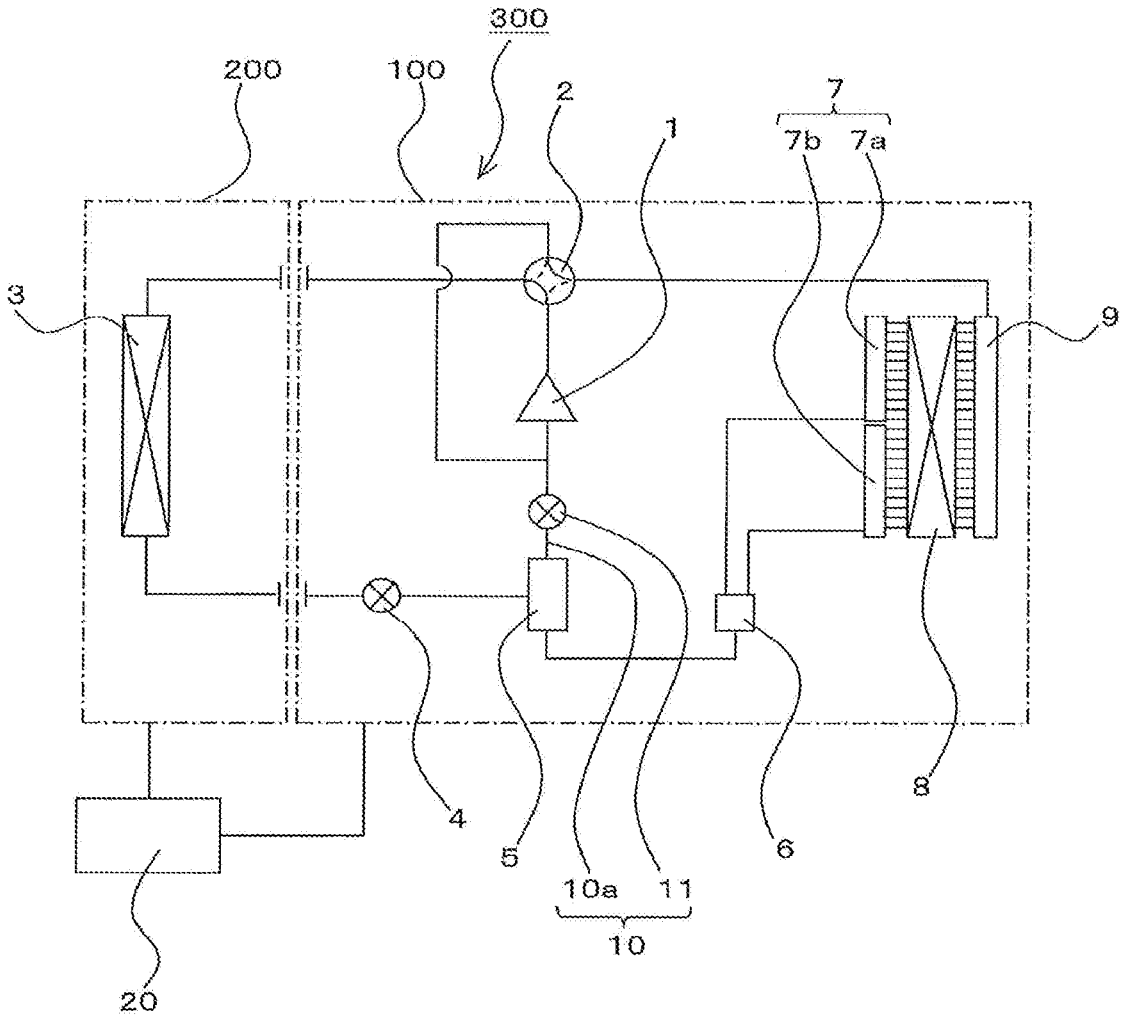
FIG. 1 is a refrigerant circuit diagram of an air-conditioning apparatus according to Embodiment 1 of the present invention.

FIG. 1 is a refrigerant circuit diagram of an air-conditioning apparatus according to Embodiment 1 of the present invention.

An air-conditioning apparatus 300 of Embodiment 1 includes a compressor 1, a four-way valve 2, an indoor heat exchanger 3, an expansion valve 4, and an outdoor heat exchanger 8. This means that at the time of heating operation, the refrigeration cycle of the air-conditioning apparatus 300 is configured such that the compressor 1, the four-way valve 2, the indoor heat exchanger 3, the expansion valve 4, and the outdoor heat exchanger 8 are connected in this order. Further, at the time of cooling operation, the refrigeration cycle of the air-conditioning apparatus 300 is configured such that the compressor 1, the four-way valve 2, the outdoor heat exchanger 8, the expansion valve 4, and the indoor heat exchanger 3 are connected in this order. As such, the indoor heat exchanger 3 functions as a condenser at the time of heating operation, and functions as an evaporator at the time of cooling operation. The outdoor heat exchanger 8 functions as an evaporator at the time of heating operation, and functions as a condenser at the time of cooling operation.

It should be noted that in the case where the air-conditioning apparatus 300 only performs either heating operation or cooling operation, the four-way valve 2 is not particularly required.

Further, the outdoor heat exchanger 8 is configured of a plurality of fins 16 and a plurality of heat transfer tubes 15, as described below. One end portion (end portion of a refrigerant inflow side at the time of heating operation) of each heat transfer tube 15 is connected with a liquid header 7, and the other end portion (end portion of a refrigerant outflow side at the time of heating operation) of each heat transfer tube 15 is connected with a gas header 9.

It should be noted that in Embodiment 1, the liquid header 7 is divided into two liquid header portions 7*a* and 7*b* in an up and down direction.

Further, the air-conditioning apparatus 300 of Embodiment 1 includes a first gas-liquid separator 5 for separating two-phase refrigerant, having flowed out of the expansion valve 4, into gas refrigerant and liquid refrigerant at the time of heating operation, and a bypass 10 that connects the first gas-liquid separator 5 and the suction side of the compressor 1 and adjusts the quantity of the gas refrigerant, separated by the first gas-liquid separator 5, to be returned to the suction side of the compressor 1. The bypass 10 connects the first gas-liquid separator 5 and the suction side of the compressor 1, and is configured of a first bypass pipe 10*a* for returning gas refrigerant, separated by the first gas-liquid separator 5, to the suction side of the compressor 1, and a flow rate control mechanism 11 (flow rate control valve, for example) that adjust the flow rate of the gas refrigerant flowing in the first bypass pipe 10*a*.

The air-conditioning apparatus 300 of Embodiment 1 further includes a shunt 6 that connects the first gas-liquid separator 5 and lower portions, for example, of the respective liquid header portions 7*a* and 7*b*, and supplies the two-phase refrigerant, in which the quality is adjusted by the first gas-liquid separator 5, to the liquid header portions 7*a* and 7*b*, respectively.

The above-described constituent elements, constituting the air-conditioning apparatus 300, are stored in an outdoor unit 100 and an indoor unit 200.

In more detail, in the outdoor unit 100, the compressor 1, the four-way valve 2, the expansion valve 4, the first gas-liquid separator 5, the shunt 6, the liquid header 7, the outdoor heat exchanger 8, the gas header 9, and the bypass 10 (first bypass pipe 10*a*, flow rate control mechanism 11) are stored. Further, in the indoor unit 200, the indoor heat exchanger 3 is stored. It should be noted that the outdoor unit 100 is also provided with a fan 12 that supplies air (outdoor air), to which heat exchange is applied, to the outdoor heat exchanger 8. The configuration of storing the fan 12 in the outdoor unit 100 will be described below.

The air-conditioning apparatus 300 of Embodiment 1 also includes a controller 20 configured of a microcomputer, for example. The controller 20 controls the rotation speed of the compressor 1, the flow channel of the four-way valve 2, the opening degree of the expansion valve 4, the opening degree of the flow rate control mechanism 11, the rotation speed (air quantity) of the fan 12, and the like.

Next, the details of the outdoor unit 100 will be described.

Figure 2:
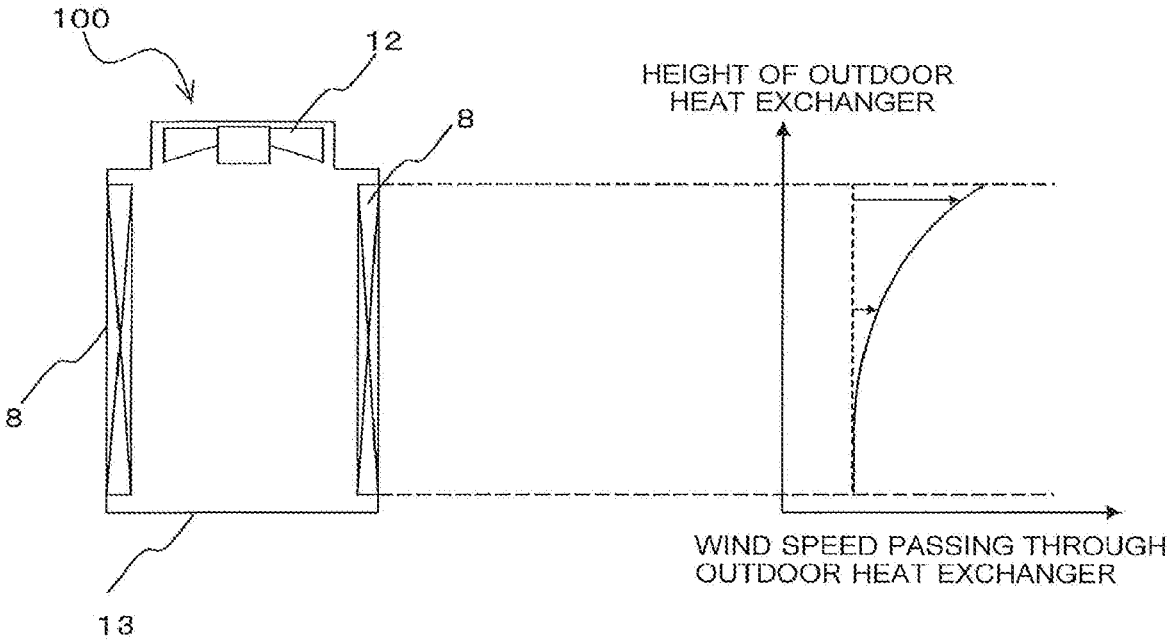
FIG. 2 is a vertical sectional view illustrating an outdoor unit of the air-conditioning apparatus according to Embodiment 1 of the present invention.
Figure 3:
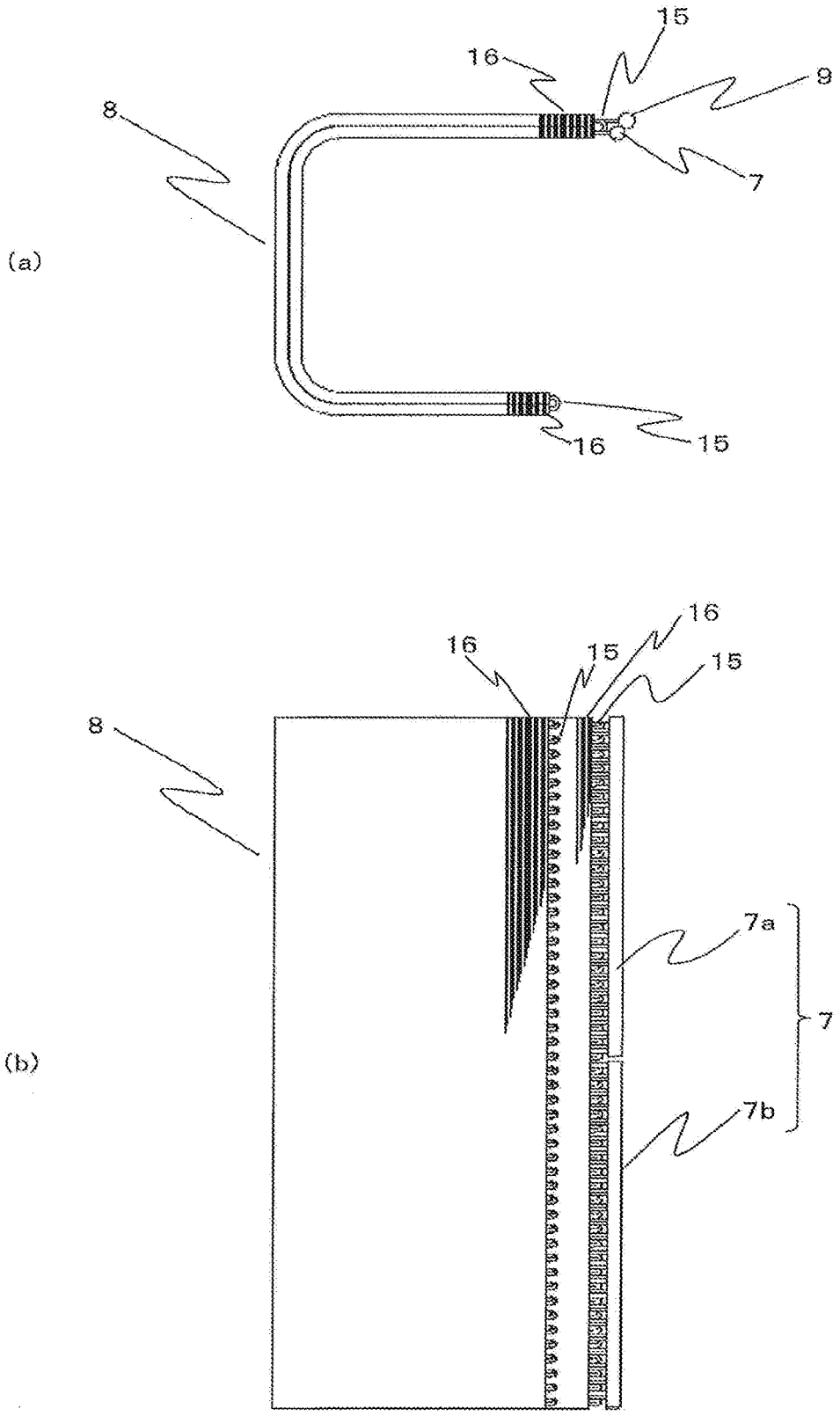
FIG. 3 illustrates an outdoor heat exchanger of the air-conditioning apparatus of according to Embodiment 1 of the present invention.

FIG. 2 is a vertical sectional view of an outdoor unit of the air-conditioning apparatus according to Embodiment 1 of the present invention. Further, FIG. 3 illustrates an outdoor heat exchanger of the air-conditioning apparatus according to Embodiment 1 of the present invention. It should be noted that in FIG. 2, wind speed distribution passing through the outdoor heat exchanger 8 is also shown. In FIG. 3, (a) is a plan view, and (b) is a side view.

The outdoor unit 100 according to Embodiment 1 includes an approximately rectangular parallelepiped casing 13. At least one side face of the casing 13 has an air inlet, and the outdoor heat exchanger 8 is provided to face the air inlet. It should be noted that in Embodiment 1, air inlets are formed in three side faces of the casing 13. As such, as shown in FIG. 3, the outdoor heat exchanger 8 according to Embodiment 1 is formed in a U shape in a plan view. It should be noted that air inlets may be formed in four side faces, rather than three side faces, of the casing 13, and the outdoor heat exchanger 8 may be formed in a square shape in a plan view, for example.

In more detail, the outdoor heat exchanger 8 is configured of a plurality of fins 16 and a plurality of heat transfer tubes 15. The fins 16 are in a substantially rectangular shape extended in the up and down direction, and the respective fins 16 are arranged in parallel in a horizontal direction at predetermined intervals. The heat transfer tubes 15 are formed in a U shape in a plan view, and the respective heat transfer tubes 15 are arranged in parallel at predetermined intervals in the up and down direction so as to penetrate the fins 16. It should be noted that the heat transfer tube 15 of Embodiment 1 is formed in a U shape, and at an end portion of one side of the U shape, it is folded to be in a U shape again. As such, both an end portion of the liquid header 7 (liquid header portions 7*a* and 7*b*) side and an end portion of the gas header 9 side of the heat transfer tube 15 are arranged at an end portion of one side of the U shape. It should be noted that the arrangement method may not be limited to an end portion of one side. For example, by allowing the refrigerant to flow in the heat transfer tubes 15 in parallel rather than folding back the heat transfer tube 15, the end portions of the liquid header 7 (liquid header portions 7*a* and 7*b*) side and the gas header 9 side may be arranged at end portions on both sides of the U shape.

Further, the outdoor unit 100 of Embodiment 1 has an air outlet formed in an upper portion of the casing 13, and the fan 12 equivalent to an outdoor fan of the present invention is provided below the air outlet. This means that the outdoor unit 100 of Embodiment 1 is configured such that the air sucked into the casing 13 by the fan 12 exchanges heat with the outdoor heat exchanger 8 and then discharged from the upper portion of the casing 13. As such, as shown in FIG. 2, as the wind speed is faster at a portion near the fan 12, the wind speed (air quantity) passing through the outdoor heat exchanger 8 increases as it comes close to the fan 12.

Figure 5:
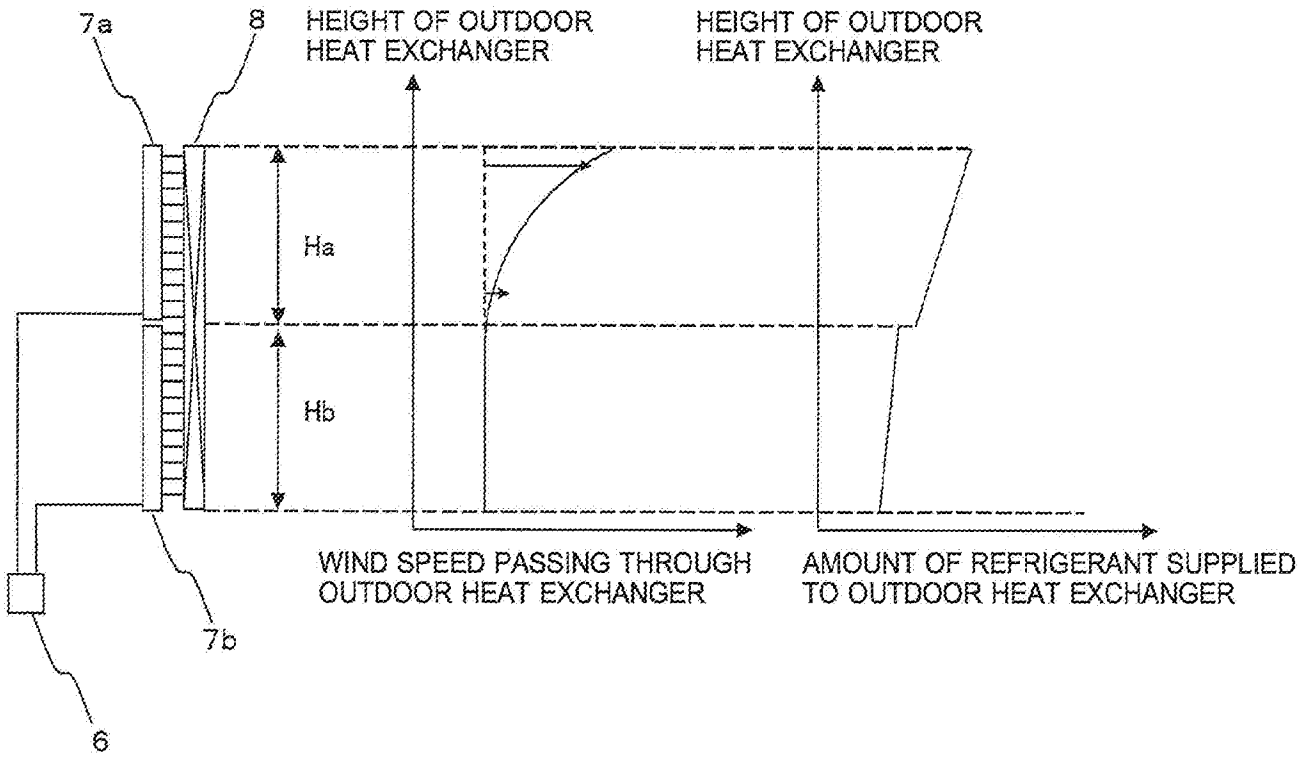
FIG. 5 illustrates distribution of refrigerant allocation in the outdoor heat exchanger of the air-conditioning apparatus according to Embodiment 1 of the present invention.

Accordingly, in Embodiment 1, the liquid header 7 has a pipe structure that is divided into two liquid header portions 7*a* and 7*b* in an up and down direction so as to extend upward and downward. As such, it is configured that the heat transfer tubes 15 arranged in an upper portion of the outdoor heat exchanger 8 are connected with the liquid header portion 7*a*, and the heat transfer tubes 15 arranged in the lower portion of the outdoor heat exchanger 8 are connected with the liquid header portion 7*b*. In other words, the outdoor heat exchanger 8 is divided into a plurality of divided regions in the up and down direction, and different liquid header portions are connected with the respective different regions. Then, in Embodiment 1, the shunt 6 supplies two-phase refrigerant of the amount corresponding to the air quantity of the divided regions connected with the liquid header portion 7*a* and 7*b*, with respect to the respective liquid header portion 7*a* and 7*b*. Specifically, the shunt 6 supplies the two-phase refrigerant to the respective liquid header portions 7*a* and 7*b* such that an average refrigerant flow rate of the heat transfer tubes 15 connected with the liquid header portion 7*a* (flow rate of two-phase refrigerant supplied to the liquid header portion 7*a*/the number of heat transfer tubes 15 connected with the liquid header portion 7*a*) becomes larger than an average refrigerant flow rate of the heat transfer tubes 15 connected with the liquid header portion 7*b* (flow rate of two-phase refrigerant supplied to the liquid header portion 7*b*/the number of heat transfer tubes 15 connected with the liquid header portion 7*b*). It should be noted that as shown in FIG. 5 described below, in Embodiment 1, the liquid header portions 7*a* and 7*b* are in the same shape (the same inner diameter and the same height (Ha=Hb)). As such, the respective liquid header portions 7*a* and 7*b* are connected with the same number of heat transfer tubes 15. Accordingly, in Embodiment 1, by the shunt 6, a larger amount of two-phase refrigerant is supplied to the liquid header portion 7*a* connected with the divided region of the upper portion of the outdoor heat exchanger 8 having a larger air quantity, than that supplied to the liquid header portion 7*b* connected with the divided region of the lower portion of the outdoor heat exchanger 8 having a smaller air quantity.

To enable allocation of refrigerant to the liquid header portions 7*a* and 7*b* in this way, the shunt 6 of Embodiment 1 is formed such that the inner diameter of the flow channels connected with the liquid header portions 7*a* and 7*b* differs according to each liquid header portion. Thereby, the amount of two-phase refrigerant supplied to each of the liquid header portions 7*a* and 7*b* can be changed.

Figure 4:
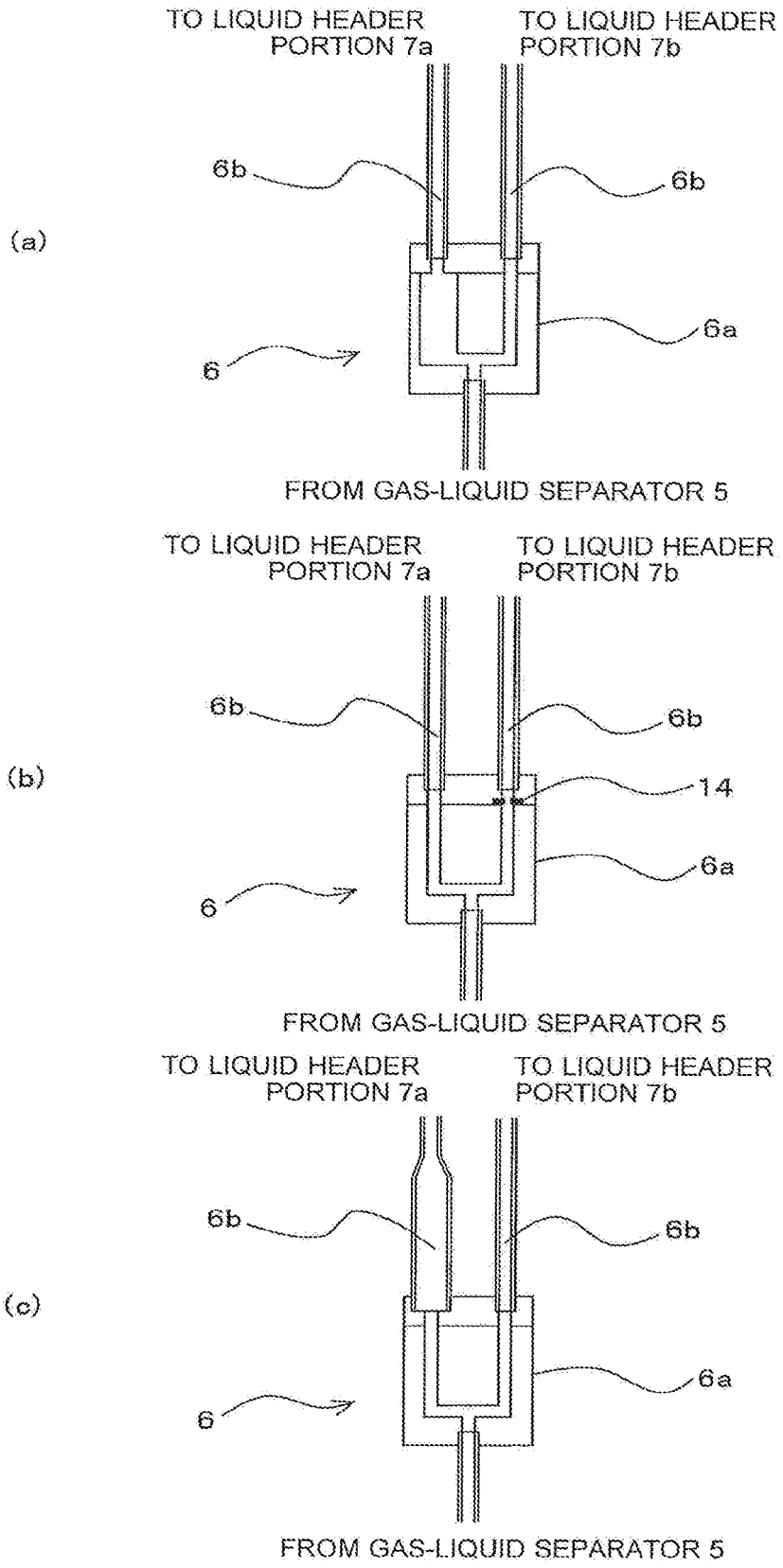
FIG. 4 is a sectional view illustrating an example of a shunt in the air-conditioning apparatus of according to Embodiment 1 of the present invention.

FIG. 4 is a sectional view illustrating an example of the shunt in the air-conditioning apparatus according to Embodiment 1 of the present invention.

The shunt 6 includes a main body 6*a* and connection pipes 6*b* of the same number as the number of liquid header portions. The main body 6*a* has a flow channel in which one end is connected with the first gas-liquid separator 5, and the other end is branched to be in the same number as the number of the liquid header portions. The connection pipe 6*b* is configured such that one end thereof is connected with another end (each branched portion) of the flow channel formed in the main body 6*a*, and the other end is connected with each of the liquid header portions 7*a* and 7*b*. In this case, as shown in FIG. 4(*a*), for example, it is acceptable that in the other end (respective branched portions) of the flow channel formed in the main body 6*a*, the sectional area of the branched portion connected with the liquid header portion 7*a* is formed to be larger than the sectional area of the branched portion connected with the liquid header portion 7*b*, and that the sectional area of the flow channel connected with the liquid header portion 7*a* is formed to be larger than the sectional area of the flow channel connected with the liquid header portion 7*b*. Meanwhile, as shown in FIG. 4(*b*), it is acceptable that in the other end (respective branched portions) of the flow channel formed in the main body 6*a*, an orifice 14 is provided to the branched portion connected with the liquid header portion 7*b*, and that the sectional area of the flow channel connected with the liquid header portion 7*a* is formed to be larger than the sectional area of the flow channel connected with the liquid header portion 7*b*. Meanwhile, as shown in FIG. 4(*c*), it is acceptable that the sectional area of the connection pipe 6*b* connected with the liquid header portion 7*a* is formed to be larger than the sectional area of the connection pipe 6*b* connected with the liquid header portion 7*b*, and that the sectional area of the flow channel connected with the liquid header portion 7*a* is formed to be larger than the sectional area of the flow channel connected with the liquid header portion 7*b*. In any case, a larger amount of refrigerant can be supplied to the liquid header portion 7*a* side connected with a divided region of larger air quantity.

Further, although not shown, the length of the connection pipe unit 6*b* connected with the liquid header portion 7*a* may be formed to be longer than the length of the connection pipe unit 6*b* connected with the liquid header portion 7*b*. Even such a configuration, a larger amount of refrigerant can be supplied to the liquid header portion 7*a* side connected with a divided region of a large air quantity.

Figure 8:
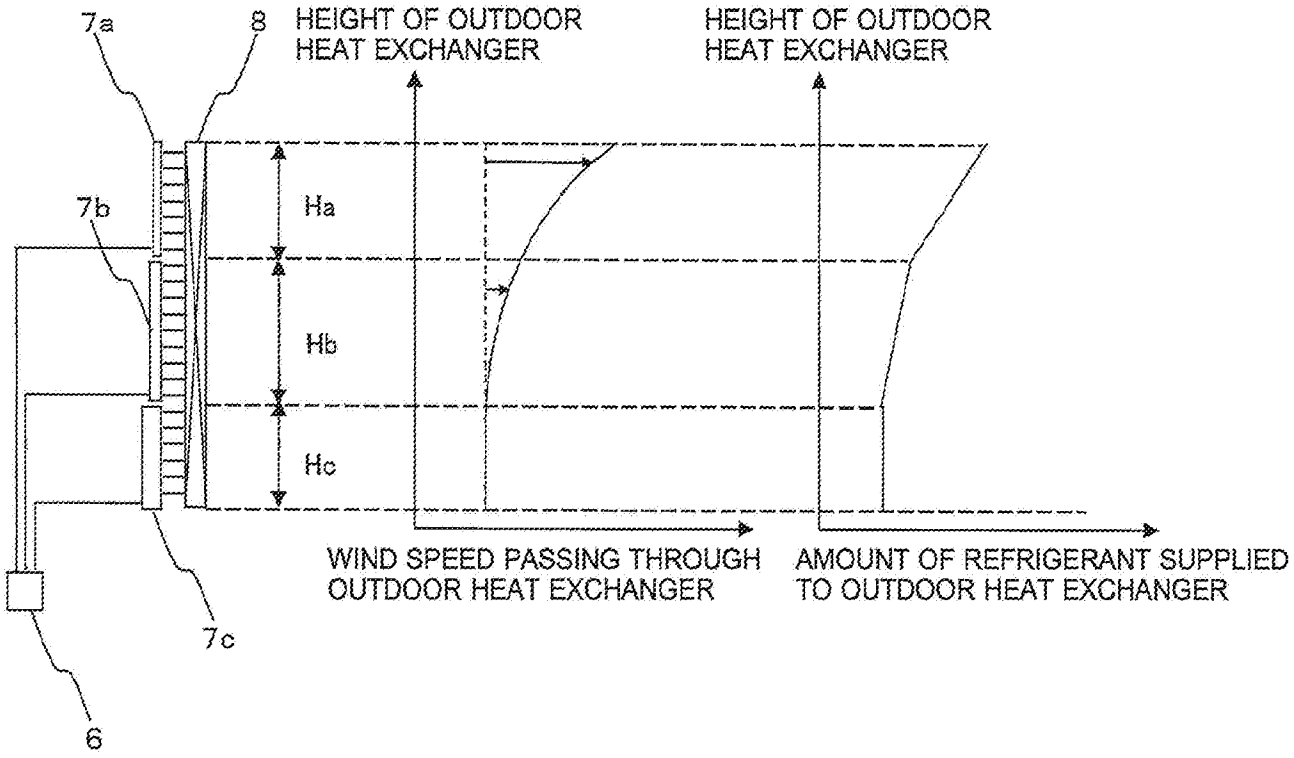
FIG. 8 illustrates distribution of refrigerant allocation in an outdoor heat exchanger of an air-conditioning apparatus according to Embodiment 4 of the present invention.
Figure 9:
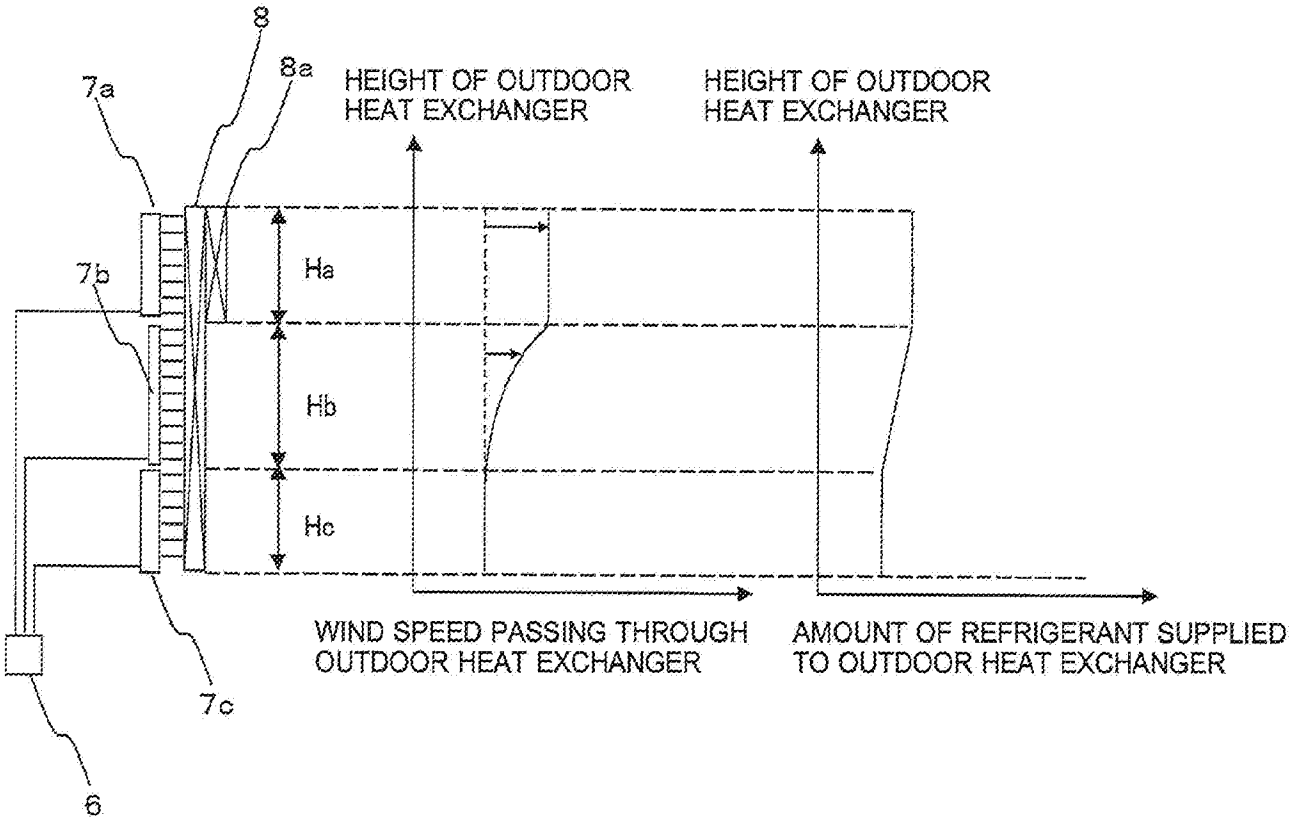
FIG. 9 illustrates distribution of refrigerant allocation in an outdoor heat exchanger of an air-conditioning apparatus according to Embodiment 5 of the present invention.

It should be noted that the flow dividing ratio of the refrigerant supplied to the liquid header portion 7*a* and the liquid header portion 7*b* may be fixed according to the air quantity distribution in an operating state where the air quantity distribution is biased most. Further, as shown in FIG. 8 or FIG. 9 described below, in the case where the liquid header 7 is divided into three or more, it is only necessary to increase the number of the branched portions of the flow channel formed in the main body 6*a* and the number of the connection pipes 6*b*.

Next, operation of the air-conditioning apparatus 300 according to Embodiment 1 will be described.

When the air-conditioning apparatus 300 performs heating operation, gas refrigerant, compressed to be high temperature and high pressure by the compressor 1, flows into the indoor heat exchanger 3 along with the solid line of the four-way valve 2, and exchanges heat with the indoor air and discharges heat to the indoor by an air sending means such as a fan not shown, whereby the gas refrigerant is condensed to be high-temperature and high-pressure liquid refrigerant. The high-temperature and high-pressure liquid refrigerant is decompressed by the expansion valve 4 to be two-phase refrigerant, and flows into the first gas-liquid separator 5. In the first gas-liquid separator 5, the two-phase refrigerant is separated into gas refrigerant and liquid refrigerant. Regarding the gas refrigerant, the flow rate thereof is controlled by the flow rate control mechanism 11, and the gas refrigerant is returned to the suction side of the compressor 1 through the bypass 10. The two-phase refrigerant, in which the quality is controlled by bypassing the gas refrigerant in the first gas-liquid separator 5, flows into the shunt 6. This means that the two-phase refrigerant, in which the amount of gas refrigerant is adjusted, flows into the shunt 6. The two-phase refrigerant having flowed in the shunt 6 is supplied to the liquid header portion 7*a* and the liquid header portion 7*b* that are divided into two. Then, the two-phase refrigerant supplied to the liquid header portion 7*a* is allocated to the respective heat transfer tubes 15 connected with the liquid header portion 7*a* (respective heat transfer tubes 15 arranged in the upper divided region in the outdoor heat exchanger 8). Further, the two-phase refrigerant supplied to the liquid header portion 7*b* is allocated to the respective heat transfer tubes 15 connected with the liquid header portion 7*b* (respective heat transfer tubes 15 arranged in the lower divided region in the outdoor heat exchanger 8).

Here, in the air-conditioning apparatus 300 according to Embodiment 1, refrigerant is allocated to the respective heat transfer tubes 15 as shown in FIG. 5.

FIG. 5 illustrates distribution of refrigerant allocation in the outdoor heat exchanger of the air-conditioning apparatus according to Embodiment 1 of the present invention.

As described above, the shunt 6 supplies, to the respective liquid header portions 7*a* and 7*b*, two-phase refrigerant of the amount corresponding to the air quantities of the divided regions connected with the liquid header portions 7*a* and 7*b*. As such, as shown in FIG. 5, a larger amount of two-phase refrigerant is supplied to the liquid header portion 7*a* connected with the upper divided region of the outdoor heat exchanger 8 of a larger air quantity, than that supplied to the liquid header portion 7*b* connected with the lower divided region of the outdoor heat exchanger 8 of a smaller air quantity. By dividing the refrigerant amount according to the air quantity, as it is possible to process a larger amount of refrigerant in the portion of a larger air quantity and to process a corresponding amount in the portion of a smaller air quantity, the outdoor heat exchanger 8 can be used efficiently.

Further, in Embodiment 1, two-phase refrigerant, in which the amount of gas refrigerant is adjusted, flows into the liquid header portions 7*a* and 7*b*. This means that the refrigerant, in which the gas refrigerant speed is adjusted, flows into the liquid header portions 7*a* and 7*b*. As such, the liquid refrigerant in the liquid header portions 7*a* and 7*b* is lifted upward accompanied by the gas refrigerant. Accordingly, with respect to the heat transfer tube 15 of a divided region, refrigerant can be supplied along with the wind speed distribution (air quantity distribution) of the divided region. As such, the performance of the outdoor heat exchanger 8 can be further improved.

It should be noted that when the wind speed distribution of the outdoor heat exchanger 8 is changed such as a case where the air quantity of the fan 12 is changed according to variation of the air conditioning load, for example, it is only necessary to adjust the amount of gas refrigerant (that is, gas refrigerant speed) supplied to the liquid header portions 7*a* and 7*b* by controlling the opening degree of the flow rate control mechanism 11. For example, when the air quantity of the fan 12 is increased so that the wind speed distribution in the divided region is largely biased, the opening degree of the flow rate control mechanism 11 may be decreased to increase the amount of gas refrigerant flowing into the liquid header portions 7*a* and 7*b* to increase the gas refrigerant speed in the liquid header portions 7*a* and 7*b*. Thereby, the amount of liquid refrigerant lifted upward is increased, which enables the refrigerant to be allocated according to the wind speed distribution in the divided region. Meanwhile, when the air quantity of the fan 12 is reduced so that the bias of the wind speed distribution in the divided region is decreased, the opening degree of the flow rate control mechanism 11 may be increased to decrease the amount of gas refrigerant flowing into the liquid header portions 7*a* and 7*b* to decrease the gas refrigerant speed in the liquid header portions 7*a* and 7*b*. Thereby, the amount of liquid refrigerant lifted upward is decreased, which enables the refrigerant to be allocated according to the wind speed distribution in the divided region.

As described above, the two-phase refrigerant, flowing into the respective heat transfer tubes 15 of the outdoor heat exchanger 8 as described above, exchanges heat with the outdoor air and absorbs heat from the outdoor and evaporates to be low-pressure gas refrigerant, passes through the four-way valve 2 and returns to the suction side of the compressor 1.

When the air-conditioning apparatus 300 performs the cooling operation, the gas refrigerant compressed to be high temperature and high pressure by the compressor 1 flows into the outdoor heat exchanger 8 along with the broken line of the four-way valve 2. As the refrigerant is single-phase gas, it is allocated and supplied almost equally to the refrigerant heat transfer tubes of the outdoor heat exchanger 8 by the gas header 9. The gas refrigerant, having flowed therein, exchanges heat with the outdoor air by the fan 12 and discharges heat to the outdoor, and is condensed to high-temperature and high-pressure liquid refrigerant. The high-temperature and high-pressure liquid refrigerant passes through the first gas-liquid separator 5 and decompressed by the expansion valve 4 to be two-phase refrigerant, and flows into the indoor heat exchanger 3. Here, the flow rate control mechanism 11 is closed to prevent the refrigerant from returning from the first gas-liquid separator 5 to the suction side of the compressor 1. In the indoor heat exchanger 3, the refrigerant exchanges heat with the indoor air and absorbs heat from the inside of the room to evaporate to become low-pressure gas refrigerant that passes through the four-way valve 2 to return to the suction side of the compressor 1.

As described above, in the air-conditioning apparatus 300 configured as Embodiment 1, two-phase refrigerant, in which the quality is adjusted by the first gas-liquid separator 5, is supplied to the shunt 6. As such, the air-conditioning apparatus 300 of Embodiment 1 is able to adjust the gas refrigerant speed flowing in the respective liquid header portions 7*a* and 7*b*. Further, in the air-conditioning apparatus 300 according to Embodiment 1, the shunt 6 supplies, to the respective liquid header portions 7*a* and 7*b*, two-phase refrigerant of the amount corresponding to the divided regions of the outdoor heat exchanger 8 connected with the respective liquid header portions 7*a* and 7*b*. As such, as the air-conditioning apparatus 300 of Embodiment 1 is able to adjust the amount of liquid refrigerant lifted upward in the liquid header portion by the gas refrigerant according to the wind speed distribution, the performance of the outdoor heat exchanger 8 can be improved sufficiently.

Embodiment 2

In Embodiment 1, the liquid header portions 7*a* and 7*b* are formed to be in the same shape. However, the shapes of the liquid header portion 7*a* and the liquid header portion 7*b* may be different. For example, the inner diameters of the liquid header portion 7*a* and the liquid header portion 7*b* may be different. It should be noted that the configurations not described in Embodiment 2 are the same as those of Embodiment 1, and the configurations that are the same as those of Embodiment 1 are denoted by the same reference numerals.

Figure 6:
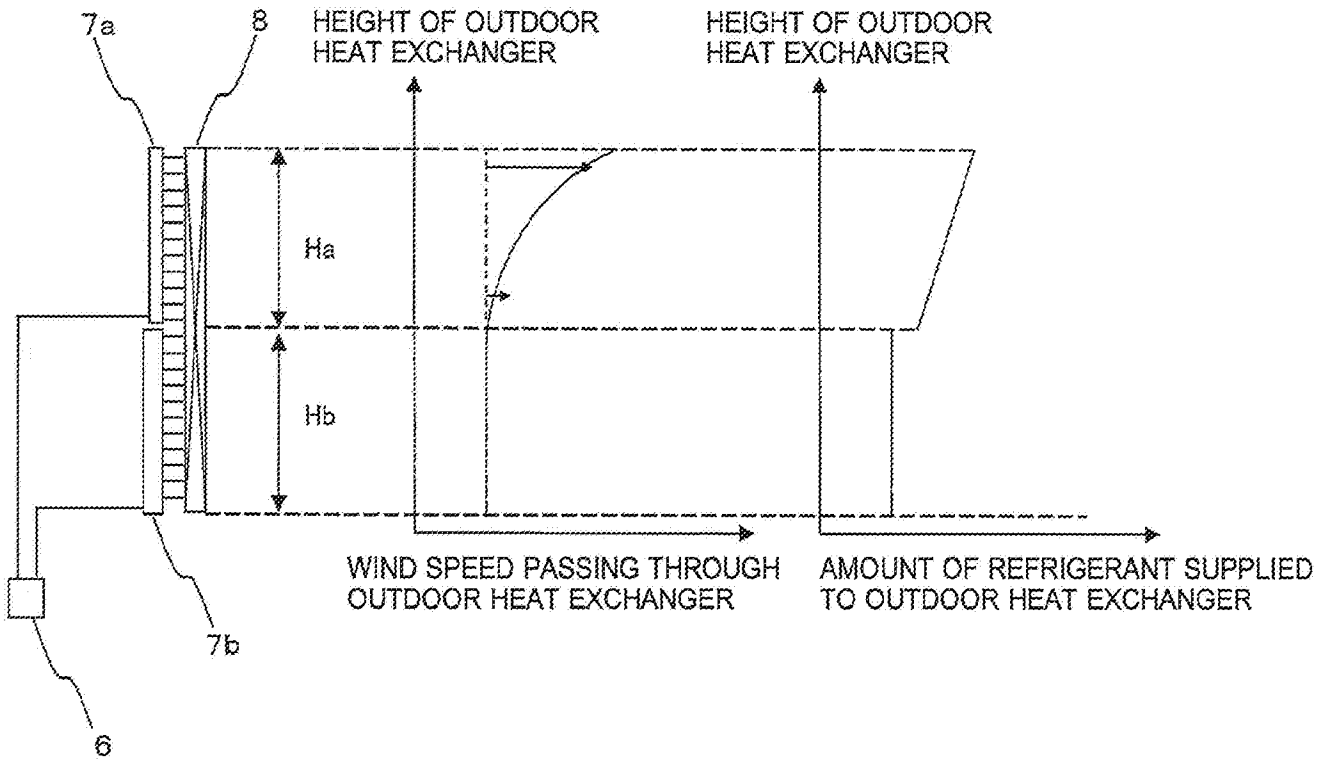
FIG. 6 illustrates distribution of refrigerant allocation in an outdoor heat exchanger of an air-conditioning apparatus according to Embodiment 2 of the present invention.

FIG. 6 illustrates distribution of refrigerant allocation in an outdoor heat exchanger of an air-conditioning apparatus according to Embodiment 2 of the present invention.

As shown in FIG. 6, even in the outdoor heat exchanger 8 of Embodiment 2, the wind speed (air quantity) passing through the outdoor heat exchanger 8 increases as it comes close to the fan 12. In such an outdoor heat exchanger 8, the distribution of the wind speed in the upper divided region is more biased compared with the distribution of the wind speed in the lower divided region. It should be noted that in the outdoor heat exchanger 8 of Embodiment 2, the distribution of the wind speed is constant in the lower divided region.

As such, in Embodiment 2, an inner diameter D7*a* of the liquid header portion 7*a*, arranged at a position close to the fan 12, is formed to be smaller than an inner diameter D7*b* of the liquid header portion 7*b*. By forming the inner diameter of the liquid header portion 7*a* to be smaller, the speed of gas refrigerant flowing in the liquid header portion 7*a* can be faster. As the flow velocity of the gas refrigerant in the liquid header portion 7*a* is faster, the liquid refrigerant in the liquid header portion 7*a* is lifted upward accompanied by the gas refrigerant. As such, even in the case where the distribution of the wind speed in a divided region is largely biased, the refrigerant can be supplied to the heat transfer tubes 15 of the divided region along the distribution of the wind speed (distribution of air quantity) of the divided region.

It should be noted that while the liquid header portions 7*a* and 7*b* of Embodiment 2 are in the same height (Ha=Hb) as in the case of Embodiment 1, the present invention is not limited to this. For example, when Ha<Hb, the capacity of a portion of the outdoor heat exchanger 8 connected with the liquid header portion 7*b* arranged at a position far from the fan 12, of the entire capacity of the outdoor heat exchanger 8, is larger, compared with the case of Ha=Hb. On the other hand, the capacity of a portion of the outdoor heat exchanger 8 connected with the liquid header portion 7*a* arranged at a position close to the fan 12 is smaller. In that case, a refrigerant flow rate G7*a* flowing in the liquid header portion 7*a* arranged at a position closer to the fan 12 is less than a refrigerant flow rate G7*b* flowing in the liquid header portion 7*b*. For example, Ha:Hb=G7*a*:G7*b* is satisfied, in proportion to the heights of the liquid header portions 7*a* and 7*b*. A refrigerant mass flux G7*a*', flowing in the liquid header portion 7*a* arranged at a position close to the fan 12 in that case, is defined by the following Expression (1), for example:

$$G7a'=G7a/\{(D7a/2)^2\times\pi\} \quad (1)$$

Similarly, a refrigerant mass flux G7*b*', flowing in the liquid header portion 7*b* arranged at a position far from the fan 12, is defined by the following Expression (2), for example:

$$G7b'=G7b/\{(D7b/2)^2\times\pi\} \quad (2)$$

At this time, when the inner diameter D7*a* of the liquid header portion 7*a* of Expression (1) is replaced with D7*a*', there is D7*a*' in which the refrigerant mass flux flowing to the liquid header portion 7*a* and the refrigerant mass flux flowing to the liquid header portion 7*b* become equal. This means that there is D7*a*' satisfying G7*a*'=G7*b*'. D7*a*' satisfies D7*a*'<D7*b*. As such, in the case of determining the inner diameters of the liquid header portions 7*a* and 7*b* to satisfy G7*a*'=G7*b*', the inner diameter of the liquid header portion 7*a* at a position close to the fan 12 is D7*a*', which is smaller than the inner diameter D7*b* of the liquid header portion 7*b* at a position far from the fan 12. However, the argument point in Embodiment 2 is not simply the size of the inner diameters of the liquid header portions 7*a* and 7*b*, but setting the inner diameter D7*a* of the liquid header portion 7*a* at a position close to the fan 12 to satisfy D7*a*<D7*a*', considering a diameter equivalent to the refrigerant mass flux. This also applies to the case of Ha>Hb.

Here, the liquid header portion 7*a* corresponds to a first liquid header portion of the present invention. The liquid header portion 7*b* corresponds to a second liquid header portion of the present invention. D7*a*' corresponds to D1 of the present invention, and D7*a* corresponds to D of the present invention.

As described above, by forming the inner diameter of the liquid header portion 7*a* arranged at a position close to the fan 12 (connected with a divided region where distribution of the wind speed is more biased) to be smaller than the inner diameter of the liquid header portion 7*b* arranged at a position away from the fan 12 (connected with a divided region where distribution of the wind speed is less biased) as in Embodiment 2, it is possible to realize refrigerant allocation along the distribution of the wind speed more, and to further improve the capability of the outdoor heat exchanger 8.

Embodiment 3

In the case of forming the liquid header portion 7*a* and the liquid header portion 7*b* to have different shapes, the heights of the liquid header portion 7*a* and the liquid header portion 7*b* may be different. It should be noted that the configurations not described in Embodiment 3 are the same as those of Embodiment 1 or Embodiment 2, and the configurations that are same as those of the above-described embodiments are denoted by the same reference numerals.

Figure 7:
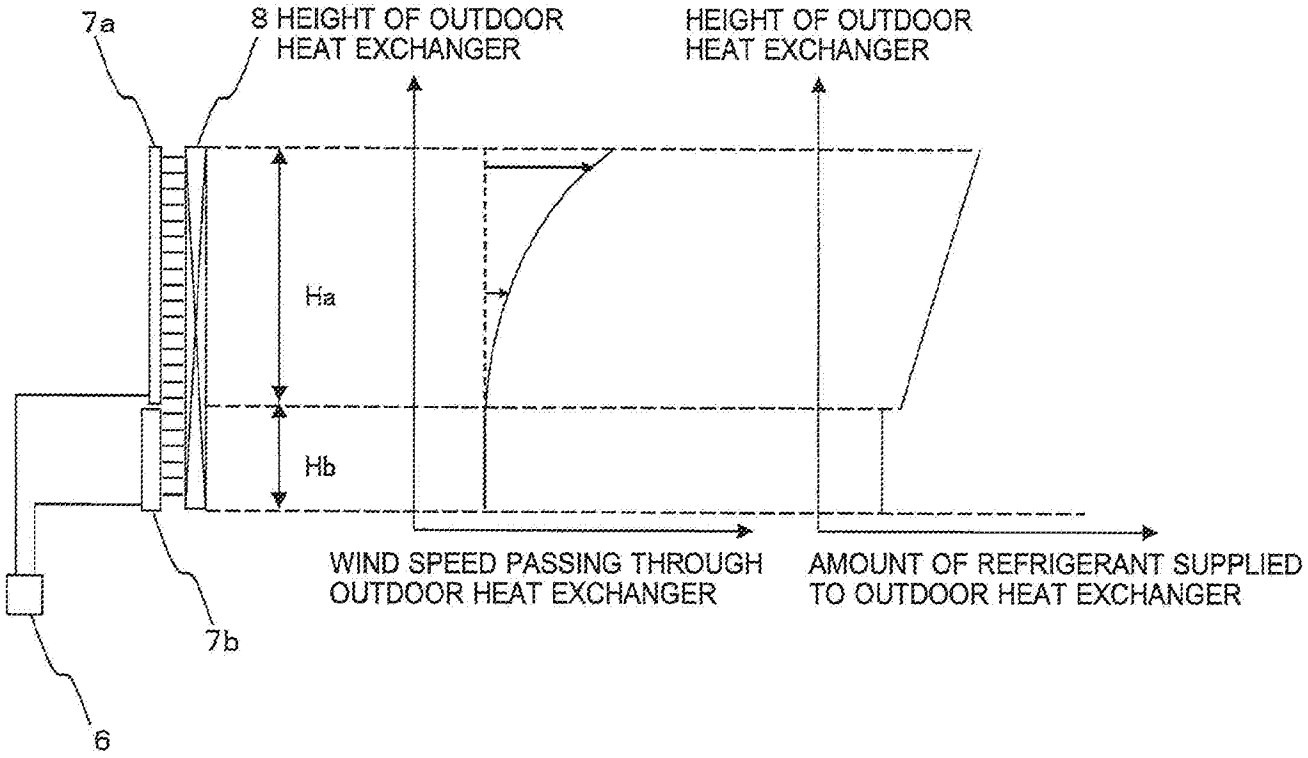
FIG. 7 illustrates distribution of refrigerant allocation in an outdoor heat exchanger of an air-conditioning apparatus according to Embodiment 3 of the present invention.

FIG. 7 illustrates distribution of refrigerant allocation in an outdoor heat exchanger of an air-conditioning apparatus according to Embodiment 3 of the present invention.

As shown in FIG. 7, in the outdoor heat exchanger 8 of Embodiment 3, the width in the up and down direction of the upper divided region, where the distribution of the wind speed distribution is more biased, is larger than the width in the up and down direction of the lower divided region where the distribution of the wind speed is less biased (constant in FIG. 7). In such a case, as shown in FIG. 7, it is only necessary to make the height Ha of the liquid header portion 7*a* higher than the height Hb of the liquid header portion 7*b*, that is, Ha>Hb.

As described above, when the width in the up and down direction of the upper divided region, where the distribution of the wind speed is more biased, is larger, by forming the height Ha of the liquid header portion 7*a* connected with the divided region to be higher, it is possible to supply more refrigerant to such a divided region, which enables refrigerant allocation along the distribution of the wind speed. Accordingly, the performance of the outdoor heat exchanger 8 can be further improved.

Embodiment 4

In Embodiments 1 to 3, the liquid header 7 is divided into two liquid header portions 7*a* and 7*b*. However, the number of divisions of the liquid header 7 is not limited to two. It is obvious that the liquid header 7 may be divided into three or more as in the case of Embodiment 4. It should be noted that the configurations not described in Embodiment 4 are the same as those in any of Embodiments 1 to 3, and the configurations that are same as those of the above-described embodiments are denoted by the same reference numerals.

FIG. 8 illustrates distribution of refrigerant allocation in an outdoor heat exchanger of an air-conditioning apparatus according to Embodiment 4 of the present invention.

In Embodiment 4, the liquid header 7 is divided into three, namely a liquid header portion 7*a* arranged in an upper portion, a liquid header portion 7*b* arranged in an intermediate portion, and a liquid header portion 7*c* arranged in a lower portion. Then, the inner diameter of the liquid header portion 7*a* connected with the upper divided region, where the distribution of the wind speed is most biased, is formed to be the smallest, the inner diameter of the liquid header portion 7*b* connected with the intermediate divided region, where the distribution of the wind speed is secondly biased, is formed to be the second smallest, and the inner diameter of the liquid header portion 7*c* connected with the lower divided region, where the distribution of the wind speed is least biased (constant), is formed to be the largest.

In the case where the distribution of the wind speed in the up and down direction of the outdoor heat exchanger 8 is suddenly increased near the fan 12, by dividing the liquid header 7 into three and forming the inner diameters of the liquid header 7 to be smaller in the order of the liquid header portion 7*c*, the liquid header portion 7*b*, and the liquid header portion 7*a*, as in the case of Embodiment 4, it is possible to supply a larger amount of refrigerant to the divided region of a larger air quantity, along the distribution of the air quantity. Accordingly, the performance of the outdoor heat exchanger 8 can be further improved.

Embodiment 5

In Embodiments 2 to 4, as the distribution of the wind speed is most biased in the upper divided region of the outdoor heat exchanger 8, the inner diameter of the liquid header portion 7*a* arranged in an upper portion (that is, arranged at a position closest to the fan 12) is formed to be the smallest. However, depending on the specification of the outdoor heat exchanger 8, there is a case where the distribution of the wind speed is most biased at a position other than the upper portion of the outdoor heat exchanger 8. In that case, the liquid header 7 may be configured as described below. It should be noted that the configurations not described in Embodiment 5 are the same as those in any of Embodiments 1 to 4, and the configurations that are the same as those of the above-described embodiments are denoted by the same reference numerals.

FIG. 9 illustrates distribution of refrigerant allocation in an outdoor heat exchanger of an air-conditioning apparatus according to Embodiment 5 of the present invention.

For example, as shown in FIG. 9, the outdoor heat exchanger 8 is configured such that an outdoor heat exchanger 8*a* is added to a part thereof and the number of columns of the heat exchangers is increased. As such, in the outdoor heat exchanger 8 of Embodiment 5, as a pressure loss of the air passing through the outdoor heat exchanger 8 is larger at a position where the outdoor heat exchanger 8*a* is added, distribution of the wind speed is leveled. As such, in Embodiment 5, distribution of the wind speed is less biased (constant) in the upper and lower divided regions of the outdoor heat exchanger 8, and distribution of the wind speed is more biased in the central divided region of the outdoor heat exchanger 8.

As such, in Embodiment 5, the liquid header 7 is divided into three, namely the liquid header portion 7*a* arranged in the upper portion, the liquid header portion 7*b* arranged in the intermediate portion, and the liquid header portion 7*c* arranged in the lower portion. Then, the inner diameter of the liquid header portion 7*b* connected with the central divided region, where distribution of the wind speed is more biased, is formed to be smaller, and the inner diameters of the liquid header portions 7*a* and 7*c* connected with the upper and lower divided regions, where distribution of the wind speed is less biased (constant), are formed to be larger. By forming the inner diameter of the liquid header portion 7*b* to be smaller than the inner diameters of the liquid header portions 7*a* and 7*c*, it is possible to supply refrigerant that is uniform in the height direction of the outdoor heat exchanger 8 to a portion where distribution of the air quantity is constant, and to supply refrigerant to a portion where distribution of the wind speed is increased along the distribution of the wind speed of the outdoor heat exchanger 8. As such, performance of the outdoor heat exchanger 8 can be improved sufficiently.

It should be noted that while FIG. 9 shows the case where the number of columns of the heat exchangers is increased, besides this, distribution of the wind speed is leveled at such a position by reducing the fin pitch of the outdoor heat exchanger 8, increasing the arrangement density of the heat transfer tubes 15 of the outdoor heat exchanger 8, or the like.

Embodiment 6

The present invention is also applicable to a multi-split type air-conditioning apparatus in which a plurality of indoor units are connected with a heat source unit (outdoor unit), and cooling or heating can be performed selectively by each indoor unit in such a manner that cooling can be performed in one indoor unit while heating can be performed in another indoor unit simultaneously. It should be noted that the configurations not described in Embodiment 6 are the same as those in any of Embodiments 1 to 5, and the configurations that are same as those of the above-described embodiments are denoted by the same reference numerals.

An air-conditioning apparatus (multi-split type air-conditioning apparatus) according to Embodiment 6 includes the outdoor unit having at least the compressor, a four-way valve, the liquid header divided into the liquid header portions in the up and down direction, the shunt, the outdoor heat exchanger, and the outdoor fan; a relay unit connected with the outdoor unit by a first connection pipe and a second connection pipe; and a plurality of indoor units each having at least an indoor heat exchanger and connected with the relay unit in parallel with each other. The outdoor unit includes a first path for guiding refrigerant, discharged from the compressor, to the second connection pipe through the four-way valve, the liquid header, and the outdoor heat exchanger; and a second path for guiding the refrigerant to the second connection pipe through the four-way valve while bypassing the liquid header and the outdoor heat exchanger, according respective operation modes of cooling, heating, cooling main, and heating main. The relay unit includes a second gas-liquid separator connected to the middle of the second connection pipe; a switching unit that selectively connects each of the indoor units and either the first connection pipe or the second connection pipe; a second bypass pipe connecting the second gas-liquid separator and each of other indoor units; a third bypass pipe connecting the first connection pipe and the second bypass pipe; and a bypass pipe flow rate control device interposed in the third bypass pipe and functioning as the expansion valve. The air conditioning apparatus further includes a third gas-liquid separator connected with the first connection pipe and functioning as the first gas-liquid separator in the heating operation mode and the heating main operation mode; a gas side outlet pipe and a flow rate control mechanism connecting the third gas-liquid separator and the suction side of the compressor, and functioning as the bypass in the heating operation mode and the heating main operation mode; and a third path for supplying two-phase refrigerant, in which quality is adjusted by the third gas-liquid separator, to the shunt, in the heating operation mode and the heating main operation mode.

Further, in the air-conditioning apparatus of Embodiment 6, the indoor unit includes an indoor heat exchanger functioning as the condenser when the indoor unit performs heating, and a first flow rate control device functioning as the expansion valve.

Figure 10:
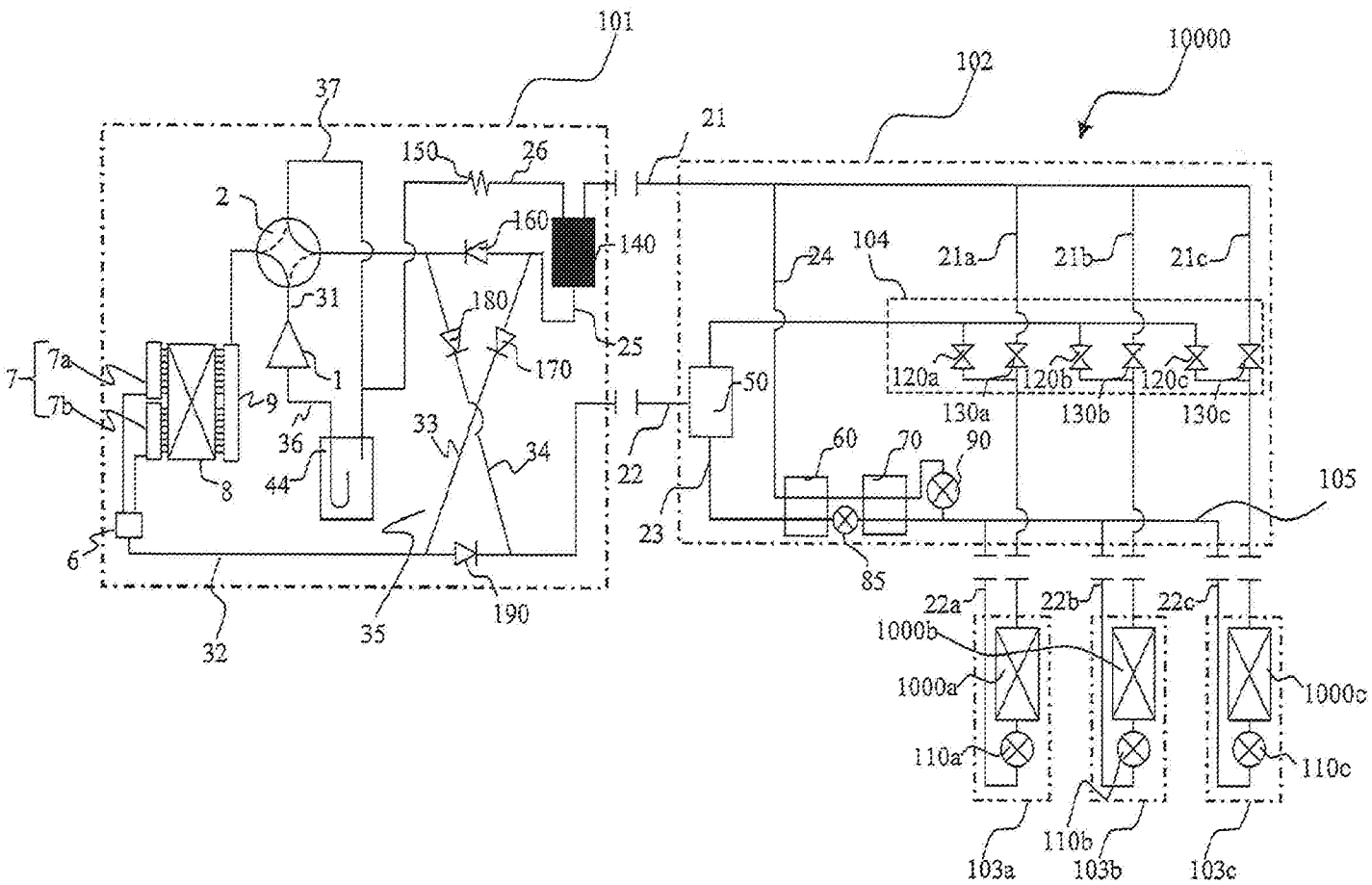
FIG. 10 is a refrigerant circuit diagram illustrating an exemplary refrigerant circuit of a multi-split type air-conditioning apparatus according to Embodiment 6 of the present invention.

FIG. 10 is a refrigerant circuit diagram illustrating an example of a refrigerant circuit configuration of a multi-split type air-conditioning apparatus 10000 according to Embodiment 6 of the present invention. Based on FIG. 10, a refrigerant circuit configuration of the multi-split type air-conditioning apparatus 10000 will be described.

The multi-split type air-conditioning apparatus 10000 according to Embodiment 6 includes an outdoor unit (also referred to as a heat source unit) 101, a relay unit 102, and a plurality of indoor units 103 (103*a*, 103*b*, and 103*c*). It should be noted that while description is given on the case where one outdoor unit is connected with one relay unit and three indoor units in this embodiment, the case of connecting two or more outdoor units, two or more relay units, and two or more indoor units is the same.

Hereinafter, configuration of each device will be described in more detail.

(Configuration of Outdoor Unit 101)

The outdoor unit 101 includes therein a compressor 1 that compresses and discharges refrigerant, a four-way valve 2 that is a switching valve for switching the refrigerant flow direction in the outdoor unit 101, a gas header 9, an outdoor heat exchanger 8, a liquid header 7 (liquid header portions 7*a* and 7*b*), a shunt 6, an accumulator 44, and a third gas-liquid separator 140. The inlet of the third gas-liquid separator 140 is connected with a first connection pipe 21 provided inside a relay unit 102 described below. A liquid side outlet pipe 25 for discharging liquid refrigerant in which gas and liquid are separated by the third gas-liquid separator 140, or two-phase refrigerant in which the quality is adjusted, is connected with the four-way valve via a check valve 160. The check valve 160 allows liquid refrigerant to flow only from the third gas-liquid separator 140 to the four-way valve 2. Further, a gas side outlet pipe 26 for discharging gas refrigerant in which gas and liquid are separated by the third gas-liquid separator 140, is connected with the inlet or the inside of the accumulator 44 via a gas side bypass flow channel resistance 150 functioning as a flow rate control mechanism. In this way, it is configured that the refrigerant in the third gas-liquid separator 140 flows in one direction to the suction side of the compressor 1.

The compressor 1, the four-way valve 2, the gas header 9, the outdoor heat exchanger 8, (the liquid header portions 7*a* and 7*b*), and the shunt 6 are connected in this order by the discharge pipe 31. Further, the outdoor heat exchanger 8 is connected with the relay unit 102 via the second connection pipe 22 narrower than the first connection pipe 21, by the refrigerant pipe 32 in which the check valve 190 is provided. The check valve 190 has a function of allowing refrigerant to flow only from the outdoor heat exchanger 8 to the second connection pipe 22. The liquid side outlet pipe 25 and the refrigerant pipe 32 are connected with each other by a short-circuit pipe 33 having a check valve 170 and a short-circuit pipe 34 having a check valve 180. Both the check valve 170 and the check valve 180 allow refrigerant to flow only from the liquid side outlet pipe 25 to the refrigerant pipe 32. The circuits having the check valves 160, 170, 180, and 190 constitute a flow channel switching circuit 35 on the outdoor unit side.

The outlet of the accumulator 44 and the suction port of the compressor 1 are connected with each other by a suction pipe 36, and the four-way valve 2 and the accumulator 44 are connected with each other by a refrigerant pipe 37.

The outdoor unit 101 is provided with a fan 12 (not shown in FIG. 10, see FIG. 2) that supplies air (outdoor air) on which heat exchange is to be performed, to the outdoor heat exchanger 8.

(Configuration of Relay Unit 102)

The outdoor unit 101 and the relay unit 102, configured as described above, are connected with each other by the first connection pipe 21 that is a wide pipe, and the second connection pipe 22 that is a pipe narrower than the first connection pipe 21.

The relay unit 102 includes a second gas-liquid separation device (intra-relay unit gas-liquid separation device) 50 connected to the middle of the second connection pipe 22. A gas phase portion of the second gas-liquid separator 50 is connected with branch pipes 21*a*, 21*b*, and 21*c* of the indoor units 103*a*, 103*b*, and 103*c* connected parallel to each other, via solenoid valves 120*a*, 120*b*, and 120*c*, respectively. The branch pipes 21*a*, 21*b*, and 21*c* are connected with indoor heat exchangers 1000*a*, 1000*b*, and 1000*c* of the indoor units 103*a*, 103*b*, and 103*c*. Further, the branch pipes 21*a*, 21*b*, and 21*c* are provided with the solenoid valves 130*a*, 130*b*, and 130*c*. Here, a circuit configured of the solenoid valves 120*a*, 120*b*, 120*c* and solenoid valves 130*a*, 130*b*, and 130*c* is called a switching unit 104. Further, the liquid phase portion of the second gas-liquid separator 50 is connected with a second bypass pipe 23, and the second bypass pipe 23 is connected with the indoor units 103*a*, 103*b*, and 103*c* via branch pipes 22*a*, 22*b*, and 22*c*, respectively. The branch pipes 22*a*, 22*b*, and 22*c* are provided with first flow rate control devices 110*a*, 110*b*, and 110*c*.

Further, a third bypass pipe 24 branching from the first connection pipe 21 is provided, and the other end of the third bypass pipe 24 is connected with the second bypass pipe 23. Between the second bypass pipe 23 and the third bypass pipe 24, a first heat exchanger 60 and a second heat exchanger 70, for exchanging heat between refrigerant flowing in the second bypass pipe 23 and refrigerant flowing in the third bypass pipe 24, are provided. Further, the second bypass pipe 23, located between the first heat exchanger 60 and second heat exchanger 70, is provided with an openable/closable third flow rate control device 85. Further, between the second heat exchanger 70 and the other end connecting portion of the third bypass pipe 24 (connecting portion with the second bypass pipe 23), an openable/closable second flow rate control device 90 (bypass pipe flow rate control device) is provided.

(Configuration of Indoor Unit 103)

The indoor units 103*a*, 103*b*, and 103*c* are connected with each other to allow refrigerant to circulate through the branch pipes 21*a*, 21*b*, and 21*c* branching from the first connection pipe 21 of the relay unit 102 and the branch pipes 22*a*, 22*b*, and 22*c* branching from the second bypass pipe 23. The respective indoor units 103*a*, 103*b*, and 103*c* include indoor heat exchangers 1000*a*, 1000*b*, and 1000*c*, and the openable/closable first flow rate control devices 110*a*, 110*b*, and 110*c*, respectively. The first flow rate control devices 110*a*, 110*b*, and 110*c* are connected in the vicinity of the indoor heat exchangers 1000*a*, 1000*b*, and 1000*c*, and at the time of cooling, they are controlled according to the degree of superheat of the outlet side of the indoor heat exchangers 1000*a*, 1000*b*, and 1000*c*, and at the time of heating, they are controlled according to the degree of subcooling.

Operational actions at the time of various types of operation performed by the multi-split type air-conditioning apparatus 10000 will be described. Operational actions by the multi-split type air-conditioning apparatus 10000 include four operation modes, namely cooling, heating, cooling main, and heating main.

In this embodiment, a cooling operation mode is an operation mode in which all operating indoor units perform cooling, and a heating operation mode is an operation mode in which all operating indoor units perform heating. A cooling main operation mode is an operation mode in which an indoor unit performing cooling operation and an indoor unit performing heating operation are mixed, and the cooling load is larger than the heating load. A heating main operation mode is an operation mode in which an indoor unit performing cooling operation and an indoor unit performing heating operation are mixed, and the heating load is larger than the cooling load.

In the cooling main operation mode, the outdoor heat exchanger 8 is connected to the discharge side of the compressor 1, and acts as a condenser (radiator). In the heating main operation mode, the outdoor heat exchanger 8 is connected to the suction side of the compressor 1, and acts as an evaporator. Hereinafter, the flow of refrigerant in each operation mode will be described.

(Heating Operation Mode)

Figure 11:
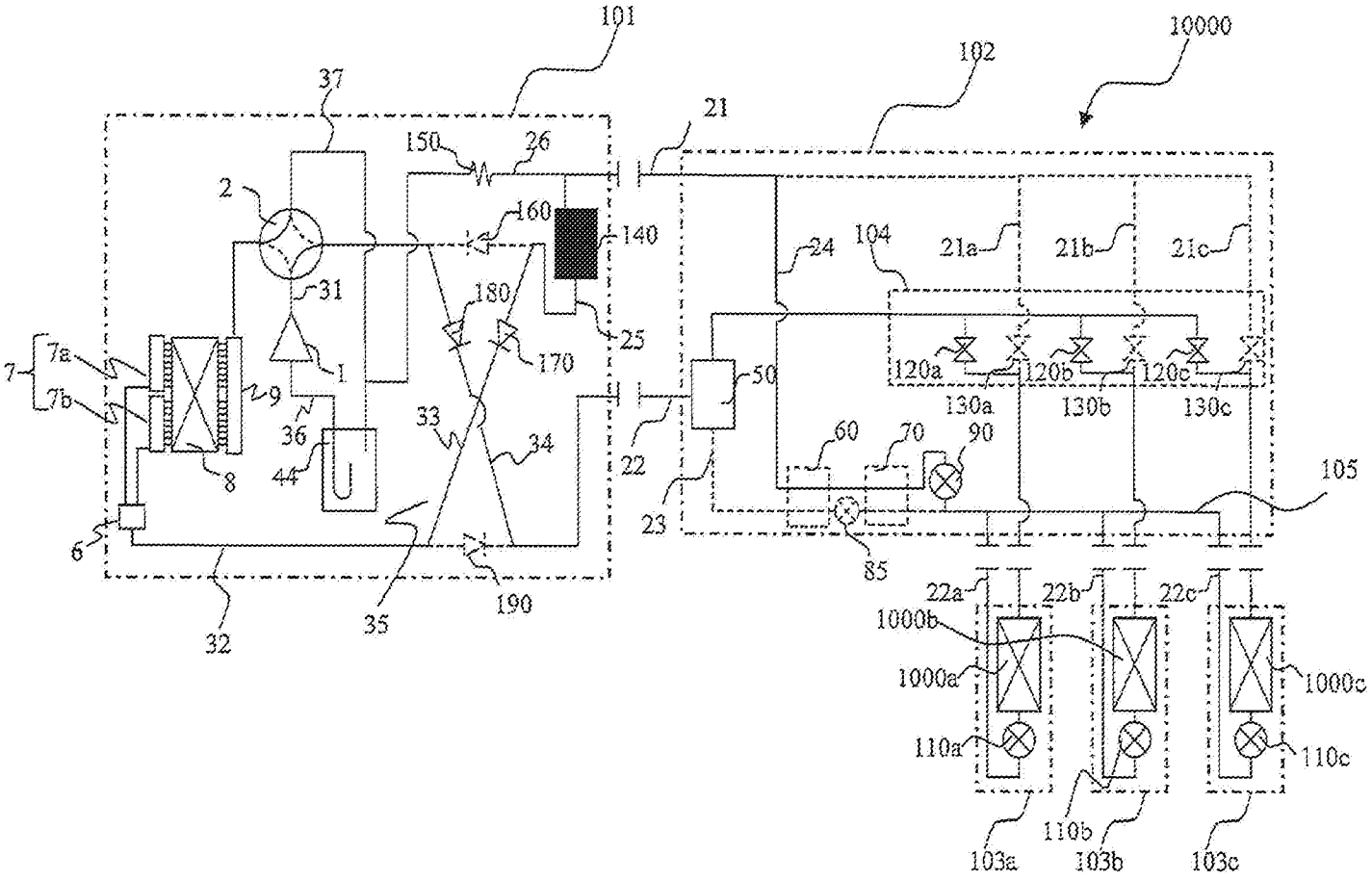
FIG. 11 is a refrigerant circuit diagram illustrating a flow of refrigerant at the time of heating operation in the multi-split type air-conditioning apparatus according to Embodiment 6 of the present invention.

FIG. 11 is a refrigerant circuit diagram illustrating a flow of refrigerant at the time of heating operation in the multi-split type air-conditioning apparatus of Embodiment 6. Here, description will be given on the case where all of the indoor units 103*a*, 103*b*, and 103*c* attempt to perform heating.

In the case of performing heating operation, the four-way valve 2 is switched such that the refrigerant discharged from the compressor 1 passes through the second connection pipe 22 to flow into the switching unit 104 configured of the solenoid valves 120*a*, 120*b*, and 120*c* and the solenoid valves 130*a*, 130*b*, and 130*c*, without bypassing through the outdoor heat exchanger 8 and the liquid header 7. Further, in the switching unit 104, the solenoid valves 130*a*, 130*b*, and 130*c* provided to the branch pipes 21*a*, 21*b*, and 21*c* are controlled to be in a closed state, and the solenoid valves 120*a*, 120*b*, and 120*c* provided to the pipes connected from the second connection pipe 22 to the indoor units 103*a*, 103*b*, and 103*c* are controlled to be in an open state. It should be noted that in FIG. 11, the pipes and devices shown by the solid lines indicate paths through which the refrigerant circulates, and the paths indicated by the dotted lines indicate that the refrigerant does not flow therethrough.

The high-temperature and high-pressure gas refrigerant, discharged from the compressor 1, passes through the four-way valve 2, the short-circuit pipe 34, and the check valve 180, and flows into the switching unit 104 via the second connection pipe 22 and the second gas-liquid separator 50. The high-temperature and high-pressure gas refrigerant, flowing in the switching unit 104, branches by the switching unit 104, and the respective portions of the refrigerant flow into the indoor heat exchangers 1000*a*, 1000*b*, and 1000*c* through the solenoid valves 120*a*, 120*b*, and 120*c*. Then, the refrigerant is cooled, while heating the indoor air, to be medium-temperature and high-pressure liquid refrigerant.

The respective portions of medium-temperature and high-pressure liquid refrigerant, having flowed out of the indoor heat exchangers 1000*a*, 1000*b*, and 1000*c*, flow into the first flow rate control devices 110*a*, 110*b*, and 110*c*, and join at a second branch portion 105 configured of the branch pipes 22*a*, 22*b*, and 22*c*, and the refrigerant further flows into the second flow rate control device 90. Then, the high-pressure liquid refrigerant is throttled by the second flow rate control device 90 to be expanded and decompressed to be in a low-temperature and low-pressure two-phase gas-liquid state.

The refrigerant in the low-temperature and low-pressure two-phase gas-liquid state, having flowed out of the second flow rate control device 90, flows into the third gas-liquid separator 140 in the outdoor unit 101 via the third bypass pipe 24 and the first connection pipe 21. The gas refrigerant, in which gas and liquid are separated by the third gas-liquid separator 140, flows into the inlet or the inside of the accumulator 44 via the gas side outlet pipe 26 and the gas side bypass flow channel resistance 150. Further, the two-phase refrigerant, in which gas and liquid are separated and the quality is controlled by the third gas-liquid separator 140, flows from the liquid side outlet pipe 25 through the short circuit pipe 33 and the check valve 170, and then flows into the shunt 6. The two-phase refrigerant, flowing in the shunt 6, is supplied to the liquid header portion 7*a* and the liquid header portion 7*b* that are divided into two. Then, the two-phase refrigerant, supplied to the liquid header portion 7*a*, is allocated to the respective heat transfer tubes 15 connected with the liquid header portion 7*a* (respective heat transfer tubes 15 arranged in the upper divided region of the outdoor heat exchanger 8). Further, the two-phase refrigerant, supplied to the liquid header portion 7*b*, is allocated to the respective heat transfer tubes 15 connected with the liquid header portion 7*b* (respective heat transfer tubes 15 arranged in the lower divided portion of the outdoor heat exchanger 8). The refrigerant flowing in the outdoor heat exchanger 8 is heated, while cooling the outdoor air, to be low-temperature and low-pressure gas refrigerant.

The low-temperature and low-pressure gas refrigerant, having flowed out of the outdoor heat exchanger 8, passes through the four-way valve 2 via the gas header 9, and joins the gas refrigerant, in which gas and liquid are separated by the third gas-liquid separator 140, at the inlet or the inside of the accumulator 44, and flows into the compressor 1 and is compressed. Afterwards, the refrigerant circulates the same path as described above.

(Cooling Operation Mode)

Figure 12:
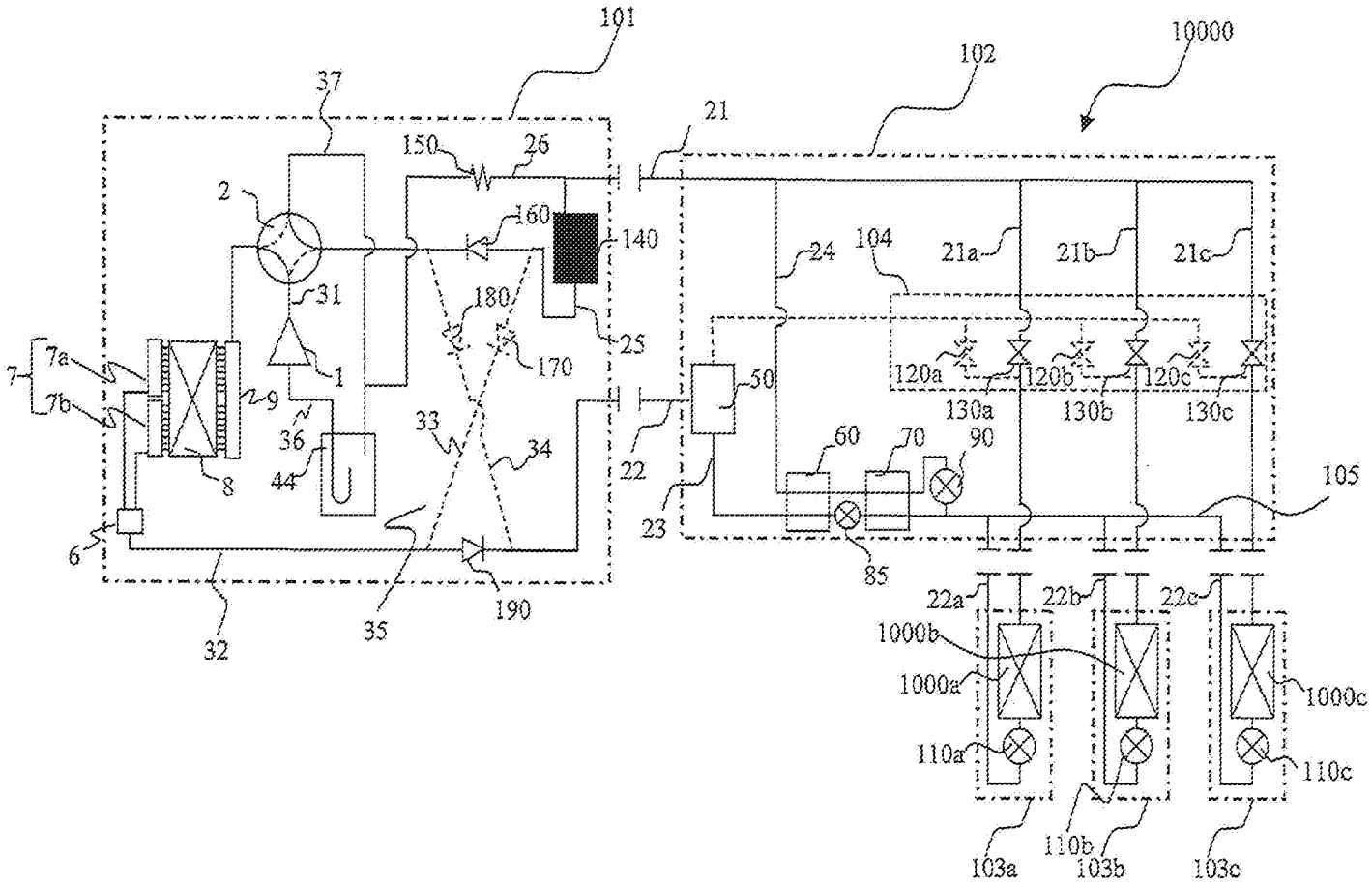
FIG. 12 is a refrigerant circuit diagram illustrating a flow of refrigerant at the time of cooling operation in the multi-split type air-conditioning apparatus according to Embodiment 6 of the present invention.

FIG. 12 is a refrigerant circuit diagram illustrating a flow of refrigerant at the time of cooling operation in the multi-split type air-conditioning apparatus according to Embodiment 6 of the present invention. Here, description will be given on the case where all of the indoor units 103*a*, 103*b*, and 103*c* attempt to perform cooling.

In the case of performing cooling, the four-way valve 2 is switched such that the refrigerant, discharged from the compressor 1, flows into the outdoor heat exchanger 8. Further, in the switching unit 104, the solenoid valves 130*a*, 130*b*, and 130*c* connected with the indoor units 103*a*, 103*b*, and 103*c* are controlled to be in an open state, and the solenoid valves 120*a*, 120*b*, and 120*c* are controlled to be in a closed state. It should be noted that in FIG. 12, the pipes and devices shown by the solid lines indicate paths in which the refrigerant circulates, and the paths shown by the dotted lines indicate that refrigerant does not flow therethrough.

The high-temperature and high-pressure gas refrigerant, discharged from the compressor 1, flows into the outdoor heat exchanger 8 via the four-way valve 2. At this time, the refrigerant is cooled, while heating the outdoor air, to be medium-temperature and high-pressure liquid refrigerant.

The medium-temperature and high-pressure liquid refrigerant, having flowed out of the outdoor heat exchanger 8, passes through the second connection pipe 22, the second gas-liquid separator 50 and the second bypass pipe 23, and the third flow rate control device 85, via the check valve 190, and in the first heat exchanger 60 and the second heat exchanger 70, exchanges heat with the refrigerant flowing in the third bypass pipe 24 to be cooled.

The liquid refrigerant cooled by the first heat exchanger 60 and the second heat exchanger 70 flows into the second branch portion 105 configured of the branch pipes 22*a*, 22*b*, and 22*c*, while allowing a part of the refrigerant to bypass to flow into the third bypass pipe 24. The high-pressure liquid refrigerant flowing in the second branch portion 105 branches at the second branch portion 105 and the respective portions of the refrigerant flow into the first flow rate control devices 110*a*, 110*b*, and 110*c*. Then, the high-pressure liquid refrigerant is throttled by the first flow rate control devices 110*a*, 110*b*, and 110*c* to be expanded and compressed to be in a low-temperature and low-pressure two-phase gas-liquid state.

The respective portions of the refrigerant in the low-temperature and low-pressure two-phase gas-liquid state, having flowed out of the first flow rate control device 110*a*, 110*b*, and 110*c*, flow into the indoor heat exchangers 1000*a*, 1000*b*, and 1000*c*. Then, the refrigerant is heated, while cooling the indoor air, to be low-temperature and low-pressure gas refrigerant.

The respective portions of the low-temperature and low-pressure gas refrigerant, having flowed out of the indoor heat exchangers 1000*a*, 1000*b*, and 1000*c*, pass through the solenoid valves 130*a*, 130*b*, and 130*c*, respectively, join the low-temperature and low-pressure gas refrigerant heated by the first heat exchanger 60 and the second heat exchanger 70 of the third bypass pipe 24, and the refrigerant flows into the first connection pipe 21. At this time, in the refrigerant circuit of the present embodiment, as the flow of the refrigerant at the inlet of the second gas-liquid separator 50 is in one direction, the gas refrigerant passing through the first connection pipe 21 flows into the third gas-liquid separator 140, and flows out while branching to the two paths, namely the gas side outlet pipe 26 and the liquid side outlet pipe 25. The gas refrigerant, flowing to the gas side outlet pipe 26, passes through the gas side bypass flow channel resistance 150 and flows into the inlet or the inside of the accumulator 44. The gas refrigerant, flowing to the liquid side outlet pipe 25, passes through the check valve 160 and flows into the accumulator 44 via the four-way valve 2.

The respective portions of gas refrigerant, branched by the third gas-liquid separator 140, join at the inlet or the inside of the accumulator 44, and the refrigerant flows into the compressor 1 and is compressed. At this time, as the gas refrigerant, having flowed in through the first connection pipe 21, is branched by the third gas-liquid separator 140, the sectional area of the flow channel in the path from the third gas-liquid separator 140 to the accumulator 44 is increased, whereby it is possible to reduce the pressure loss in the path. As such, the compressor suction temperature is maintained at a high level, so that the performance of the compressor 1 is improved.

(Heating Main Operation Mode)

Figure 13:
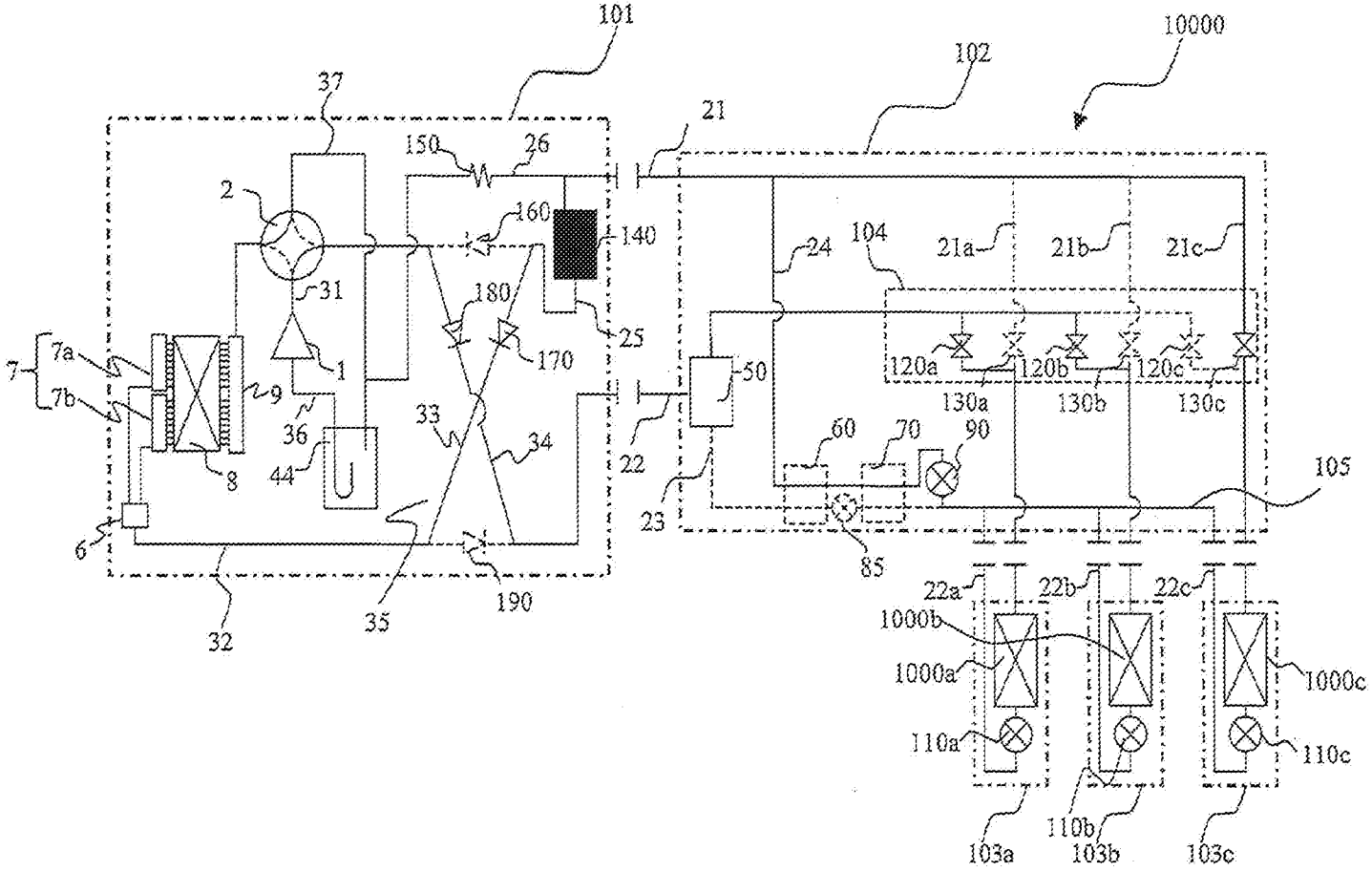
FIG. 13 is a refrigerant circuit diagram illustrating a flow of refrigerant at the time of heating main operation in the multi-split type air-conditioning apparatus according to Embodiment 6 of the present invention.

FIG. 13 is a refrigerant circuit diagram illustrating a flow of refrigerant at the time of heating main operation in the multi-split type air-conditioning apparatus according to Embodiment 6 of the present invention. Here, description will be given on the case where the indoor unit 103*c* performs cooling and the indoor units 103*a* and 103*b* perform heating. In this case, the four-way valve 2 is switched such that the refrigerant discharged from the compressor 1 passes through the second connection pipe 22 and flows into the switching unit 104 configured of the solenoid valves 120*a*, 120*b*, and 120*c* and the solenoid valves 130*a*, 130*b*, and 130*c*. Further, in the switching unit 104, the solenoid valves 130*a*, 130*b*, and 120*c* connected with the indoor units 103*a*, 103*b*, and 103*c* are controlled to be in a closed state, and the solenoid valves 120*a*, 120*b*, and 130*c* are controlled to be in an open state. It should be noted that in FIG. 13, the pipes and the devices shown by the solid lines indicate paths in which refrigerant flows, and the paths shown by the dotted lines indicate that refrigerant does not flow therethrough.

The high-temperature and high-pressure gas refrigerant, discharged from the compressor 1, passes through the four-way valve 2, the short-circuit pipe 34, and the check valve 180, and flows into the switching unit 104 via the second connection pipe 22 and the second gas-liquid separator 50. The high-temperature and high-pressure gas refrigerant, flowing in the switching unit 104, is branched by the switching unit 104, and the respective portions of the refrigerant pass through the solenoid valves 120*a*, and 120*b*, and flow into the indoor heat exchangers 1000*a* and 1000*b* that perform heating. Then, the refrigerant is cooled, while heating the indoor air, to be medium-temperature and high-pressure liquid refrigerant.

The respective portions of the medium-temperature and high-pressure liquid refrigerant, having flowed out of the indoor heat exchangers 1000*a* and 1000*b*, flow into the first flow rate control devices 110*a* and 110*b*, and join at the second branch portion 105 configured of the branch pipes 22*a*, 22*b*, and 22*c*. A portion of the high-pressure liquid refrigerant, joined at the second branch portion 105, flows into the first flow rate control device 110*c* connected with the indoor unit 103*c* that performs cooling. Then, the high-pressure liquid refrigerant is throttled by the first flow rate control device 110*c* and expanded to be in a low-temperature and low-pressure two-phase gas-liquid state. The refrigerant in the low-temperature and low-pressure two-phase gas-liquid state, having flowed out of the first flow rate control device 110*c*, flows into the indoor heat exchanger 1000*c*. Then, the refrigerant is heated, while cooling the indoor air, to be low-temperature and low-pressure gas refrigerant. The low-temperature and low-pressure gas refrigerant, having flowed out of the indoor heat exchanger 1000*c*, passes through the solenoid valve 130*c* and flows into the first connection pipe 21.

On the other hand, the residual of the high-pressure liquid refrigerant flowing from the indoor heat exchangers 1000*a* and 1000*b*, performing heating, to the second branch portion 105 flows into the second flow rate control device 90. Then, the high-pressure liquid refrigerant is throttled by the second flow rate control device 90 to be expanded (decompressed) to be in a low-temperature and low-pressure two-phase gas-liquid. The refrigerant in the low-temperature and low-pressure two-phase gas-liquid state, having flowed out of the second flow rate control device 90, passes through the third bypass pipe 24 and flows into the first connection pipe 21, and joins the refrigerant in a low-temperature and low-pressure vapor state having flowing from the indoor heat exchanger 1000*c* that performs cooling.

The refrigerant in the low-temperature and low-pressure two-phase gas-liquid state, joined at the first connection pipe 21, flows into the third gas-liquid separator 140 in the outdoor unit 101. The gas refrigerant, in which gas and liquid are separated by the third gas-liquid separator 140, flows into the inlet or the inside of the accumulator 44, via the gas side outlet pipe 26 and the gas side bypass flow channel resistance 150. The two-phase refrigerant, in which gas and liquid are separated and the quality is controlled by the third gas-liquid separator 140, flows from the liquid side outlet pipe 25 through the short circuit pipe 33 and the check valve 170, into the shunt 6. The two-phase refrigerant flowing in the shunt 6 is supplied to the liquid header portion 7*a* and the liquid header portion 7*b* that are divided into two. Then, the two-phase liquid refrigerant, supplied to the liquid header portion 7*a*, is allocated to the respective heat transfer tubes 15 connected with the liquid header portion 7*a* (respective heat transfer tubes 15 arranged in the upper divided region of the outdoor heat exchanger 8). Further, the two-phase refrigerant, supplied to the liquid header portion 7*b*, is allocated to the respective heat transfer tubes 15 connected with the liquid header portion 7*b* (respective heat transfer tubes 15 arranged in the lower divided portion of the outdoor heat exchanger 8). The refrigerant having flowed into the outdoor heat exchanger 8 absorbs heat from the outdoor air and is heated, while cooling the outdoor air, to be low-temperature and low-pressure gas refrigerant. The low-temperature and low-pressure gas refrigerant, having flowed out of the outdoor heat exchanger 8, passes through the four-way valve 2, joins the gas refrigerant, in which gas and liquid are separated by the third gas-liquid separator 140, at the inlet or the inside of the accumulator 44, and the refrigerant flows into the compressor 1 and is compressed. At this time, by allowing a part of gas refrigerant to bypass by the third gas-liquid separator 140, it is possible to reduce a pressure loss of the outdoor heat exchanger 8.

It should be noted that a configuration without the accumulator 44 may be possible. In that case, the gas side outlet pipe 26 is connected to the suction side of the compressor 1.

(Cooling Main Operation Mode)

Figure 14:
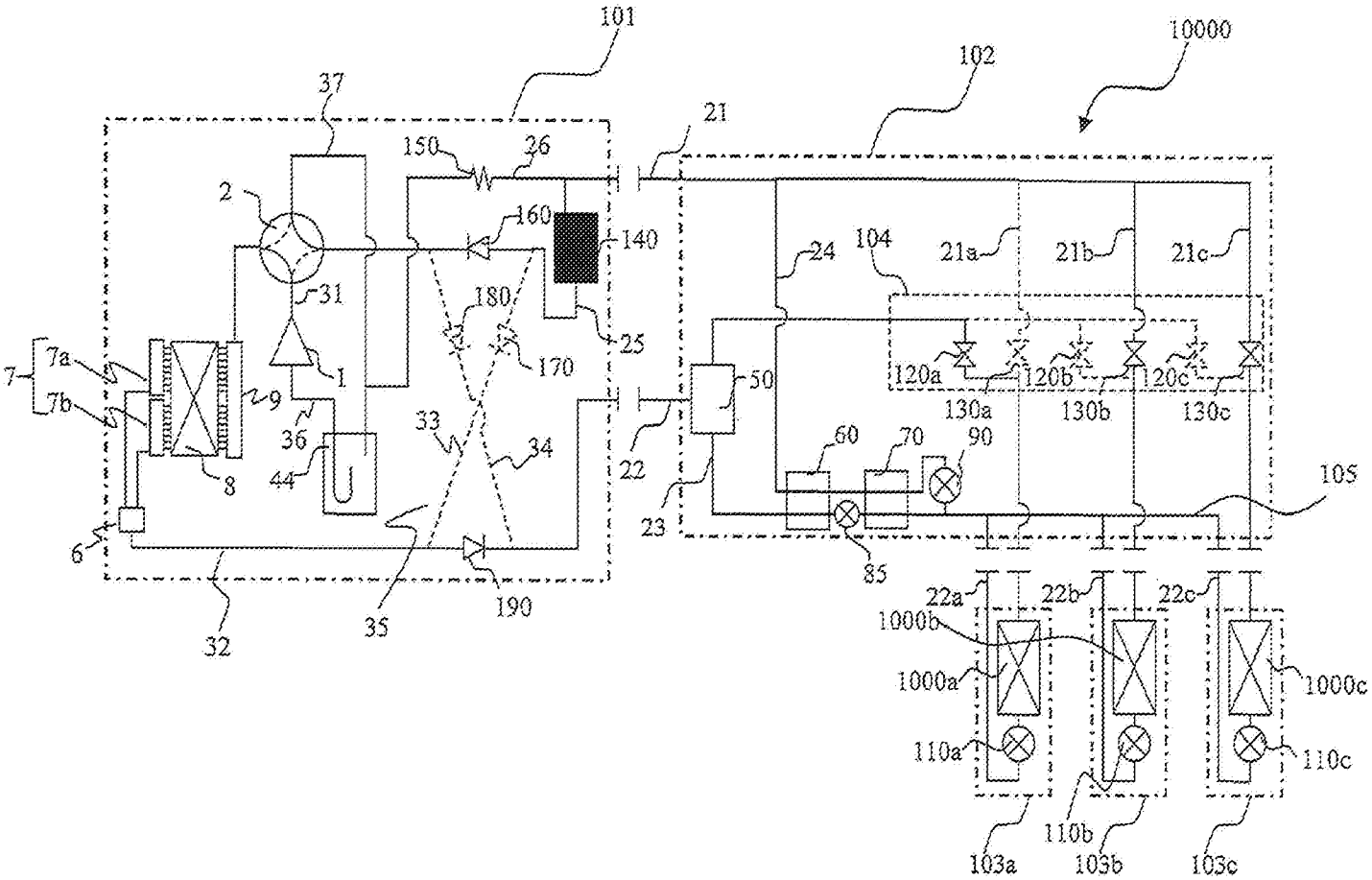
FIG. 14 is a refrigerant circuit diagram illustrating a flow of refrigerant at the time of cooling main operation in the multi-split type air-conditioning apparatus according to Embodiment 6 of the present invention.

FIG. 14 is a refrigerant circuit diagram illustrating a flow of refrigerant at the time of cooling main operation in the multi-split type air-conditioning apparatus according to Embodiment 6 of the present invention. Here, description will be given on the case where the indoor units 103*b* and 103*c* perform cooling and the indoor unit 103*a* performs heating. In that case, the four-way valve 2 is switched such that the refrigerant, discharged from the compressor 1, flows into the outdoor heat exchanger 8. Further, in the switching unit 104, the solenoid valves 120*a*, 130*b*, and 130*c* connected with the indoor units 103*a*, 103*b*, and 103*c* are controlled to be in an open state, and the solenoid valves 130*a*, 120*b*, and 120*c* are controlled to be in a closed state. It should be noted that in FIG. 14, the pipes and the devices shown by the solid lines indicate paths in which refrigerant flows, and the paths shown by the dotted lines indicate that refrigerant does not flow therethrough.

The high-temperature and high-pressure gas refrigerant discharged from the compressor 1 flows into the outdoor heat exchanger 8 via the four-way valve 2. At this time, in the outdoor heat exchanger 8, the refrigerant is cooled while heating the outdoor air, remaining the amount of heat required for heating, to be in a medium-temperature and high-pressure two-phase gas-liquid state.

The medium-temperature and high-pressure two-phase gas-liquid refrigerant, having flowed out of the outdoor heat exchanger 8, passes through the second connection pipe 22 via the check valve 190 and flows into the second gas-liquid separator 50. Then, in the second gas-liquid separator 50, it is separated into gas refrigerant and liquid refrigerant.

The gas refrigerant, separated by the second gas-liquid separator 50, flows into the indoor heat exchanger 1000*a* that performs heating, via the solenoid valve 120*a*. Then, the refrigerant is cooled, while heating the indoor air, to be medium-temperature and high-pressure gas refrigerant.

On the other hand, the liquid refrigerant, separated by the second gas-liquid separator 50, flows into the first heat exchanger 60, and exchanges heat with the low-pressure refrigerant flowing in the third bypass pipe 24 to be cooled.

The refrigerant having flowed out of the indoor heat exchanger 1000*a* that performs heating and the refrigerant having flowed out of the first heat exchanger 60 pass through the first flow rate control device 110*a* and the third flow rate control device 85, and the second heat exchanger 70, respectively, and join.

The joined liquid refrigerant branches at the second branch portion 105 configured of the branch pipes 22*a*, 22*b*, and 22*c*, while allowing a portion of the refrigerant to bypass to flow into the third bypass pipe 24, and the respective portions of the refrigerant flow into the first flow rate control devices 110*b* and 110*c* of the indoor units 103*b* and 103*c* that perform cooling. Then, the high-pressure liquid refrigerant is throttled by the first flow rate control devices 110*b* and 110*c* and expanded and decompressed to be in a low-temperature and low-pressure two-phase gas-liquid state. Changes in the state of the respective portions of the refrigerant by the first flow rate control devices 110*b* and 110*c* are performed under a condition that enthalpy is constant.

The respective portions of the refrigerant in the low-temperature and low-pressure two-phase gas-liquid state, having flowed out of the first flow rate control devices 110*b* and 110*c*, flow into the indoor heat exchangers 1000*b* and 1000*c* that perform cooling. Then, the refrigerant is heated, while cooling the indoor air, to be low-temperature and low-pressure gas refrigerant.

The respective portions of the low-temperature and low-pressure gas refrigerant, having flowed out of the indoor heat exchanger 1000*b* and 1000*c*, pass through the solenoid valves 130*b* and 130*c* respectively and join, and the refrigerant passes through the first connection pipe 21. Then, the low-temperature and low-pressure gas refrigerant flowing in the first connection pipe 21 in a joined state, further joins the low-temperature and low-pressure gas refrigerant heated by the first heat exchanger 60 and the second heat exchanger 70 in the third bypass pipe 24, and flows into the first connection pipe 21.

The gas refrigerant, passing through the first connection pipe 21, flows into the third gas-liquid separator 140 in the outdoor unit 101, and flows out while branching to two paths namely the gas side outlet pipe 26 and the liquid side outlet pipe 25. The gas refrigerant, having flowed out to the gas side outlet pipe 26, passes through the gas side bypass flow channel resistance 150 and flows into the inlet or the inside of the accumulator 44. The gas refrigerant, having flowed out of the liquid side outlet pipe 25, passes through the check valve 160 and flows into the accumulator 44 via the four-way valve 2. The gas refrigerant, branched by the third gas-liquid separator 140, joins at the inlet or the inside of the accumulator 44, and the refrigerant flows into the compressor 1 and is compressed. At this time, as the gas refrigerant having flowed in through the first connection pipe 21 is branched by the third gas-liquid separator 140, the sectional area of the flow channel from the third gas-liquid separator 140 to the accumulator 44 is increased, whereby it is possible to reduce a pressure loss in the path. As such, the compressor suction temperature is maintained at a high level, and the performance of the compressor 1 is improved.

As described above, even in the multi-split type air-conditioning apparatus 10000 configured as Embodiment 6, in the heating operation mode and the heating main operation mode, two-phase refrigerant in which quality is adjusted by the third gas-liquid separator 140 is supplied to the shunt 6. As such, even in the multi-split type air-conditioning apparatus 10000 of Embodiment 6, the speed of the gas refrigerant flowing through the respective liquid header portions 7*a* and 7*b* can be adjusted. Further, even in the multi-split type air-conditioning apparatus 10000 according to Embodiment 6, the shunt 6 supplies, to the respective liquid header portions 7*a* and 7*b*, two-phase refrigerant of the amount corresponding to the divided regions of the outdoor heat exchanger 8 to which the respective liquid header portions 7*a* and 7*b* are connected. As such, even in the multi-split type air-conditioning apparatus 10000 of Embodiment 6, the amount of liquid refrigerant lifted upward by the gas refrigerant in the liquid header portion can be adjusted according to the distribution of the wind speed, and the refrigerant can be supplied to the divided region along the distribution of the wind speed. As such, performance of the outdoor heat exchanger 8 can be improved sufficiently.

It should be noted that while Embodiment 6 describes an example using the outdoor heat exchanger 8 and the liquid header 7 shown in Embodiment 1, the outdoor heat exchanger 8 and the liquid header 7 described in Embodiments 2 to 5 may be used. The effects described in Embodiments 2 to 5 can be achieved.

Further, the first heat exchanger 60, the second heat exchanger 70, and the third flow rate control device 85, provided to the second bypass pipe 23, are used for increasing the degree of subcooling of the liquid refrigerant flowing out of the second gas-liquid separator 50. As such, the first heat exchanger 60, the second heat exchanger 70, and the third flow rate control device 85 are not indispensable configurations in the present invention.

Embodiment 7

The multi-split type air-conditioning apparatus 10000, in which the present invention can be implemented, is not limited to the multi-split type air-conditioning apparatus 10000 described in Embodiment 6. It may be configured as described below. It should be noted that the configurations not described in Embodiment 7 are the same as those in any of Embodiments 1 to 6, and the configurations that are the same as those of the above-described embodiments are denoted by the same reference numerals.

In an air-conditioning apparatus (multi-split type air-conditioning apparatus) according to Embodiment 7, the relay unit includes a plurality of intermediate heat exchangers functioning as the condensers when the indoor units perform heating, and a plurality of first flow rate control devices connected with the respective intermediate heat exchangers and functioning as the expansion valves.

The indoor unit includes an indoor heat exchanger connected with the intermediate heat exchanger. To allow the refrigerant to flow in the outdoor unit and the intermediate heat exchanger of the relay unit, a closed first refrigerant circuit is configured, and to allow refrigerant other than the above-described refrigerant to flow in the indoor unit and the intermediate heat exchanger of the relay unit, a closed second refrigerant circuit is configured.

Figure 15:
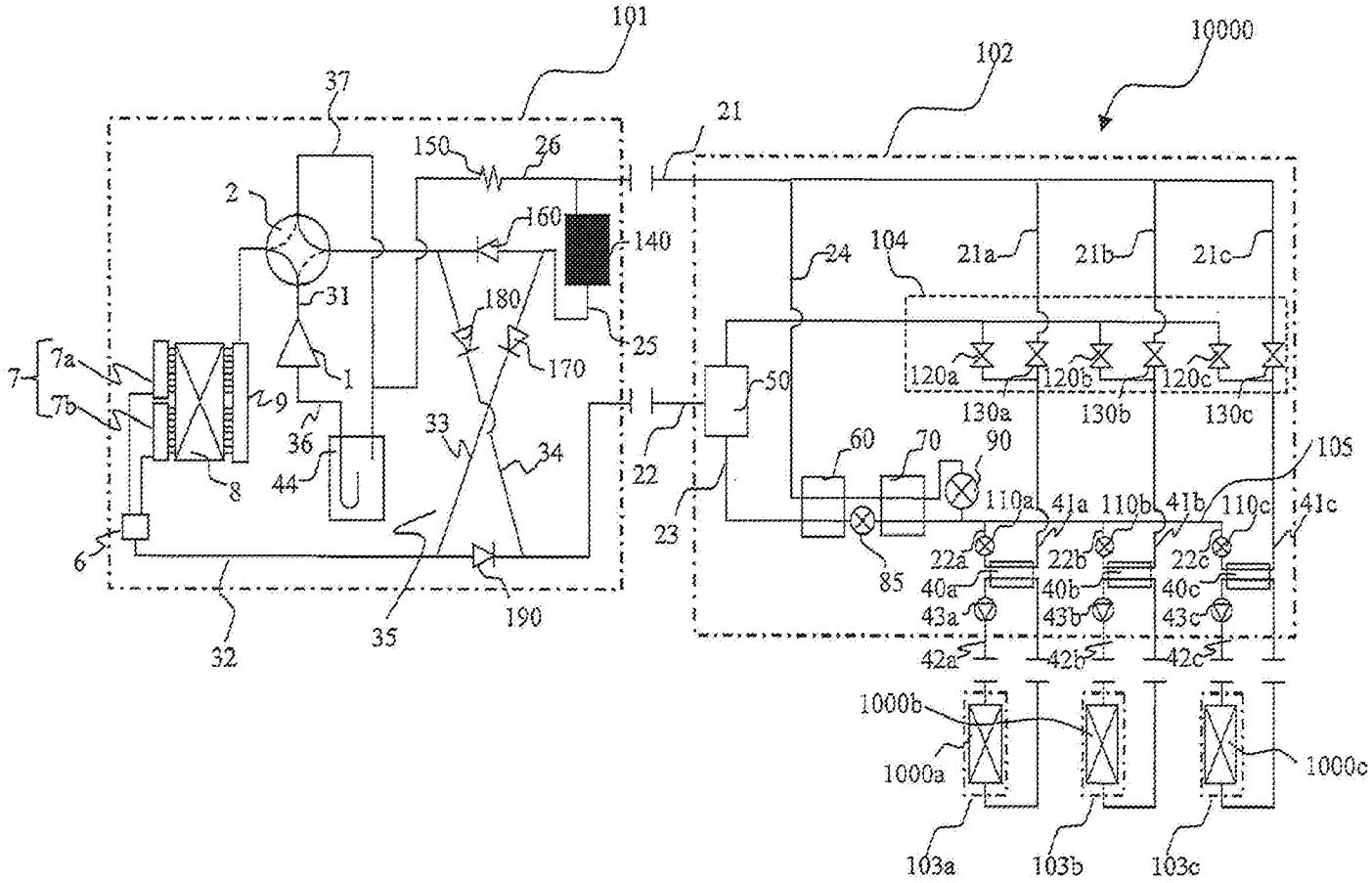
FIG. 15 is a refrigerant circuit diagram illustrating an exemplary refrigerant circuit configuration of a multi-split type air-conditioning apparatus according to Embodiment 7 of the present invention.

FIG. 15 is a refrigerant circuit diagram illustrating an example of a refrigerant circuit of the multi-split type air-conditioning apparatus according to Embodiment 7 of the present invention. States of the four-way valve 2 and the solenoid valves 120*a*, 120*b*, 120*c*, 130*a*, 130*b*, and 130*c* in the respective operation modes will be described below.

FIG. 15 shows the orientation of the four-way valve 2 at the time of cooling operation. At the time of cooling operation, the solenoid valves 120*a*, 120*b*, and 120*c* in the relay unit 102 are controlled to be in a closed state, and the solenoid valves 130*a*, 130*b*, and 130*c* are controlled to be in an open state.

At the time of heating operation, the four-way valve 2 is switched such that the refrigerant flows from the compressor 1 to the indoor unit 103, and the solenoid valves 120*a*, 120*b*, and 120*c* in the relay unit 102 are controlled to be in an open state, and the solenoid valves 130*a*, 130*b*, and 130*c* are controlled to be in a closed state.

At the time of cooling main operation, when the indoor unit 103*c* performs heating operation and the indoor units 103*a* and 103*b* perform cooling operation, for example, the four-way valve 2 is switched such that the refrigerant flows from the compressor 1 to the outdoor heat exchanger 8, the solenoid valves 130*a*, 130*b*, and 120*c* in the relay unit 102 are controlled to be in an open state, and the solenoid valves 120*a*, 120*b*, and 130*c* are controlled to be in a closed state.

In the heating main operation, when the indoor unit 103*c* performs cooling operation and the indoor units 103*a* and 103*b* perform heating operation, for example, the four-way valve 2 is switched such that the refrigerant flows from the compressor 1 to the indoor unit 103, the solenoid valves 120*a*, 120*b*, and 130*c* in the relay unit 102 are controlled to be in an open state, and the solenoid valves 130*a*, 130*b*, and 120*c* are controlled to be in a closed state.

Further, in Embodiment 7, a relay unit side refrigerant circuit 41 (41*a*, 41*b*, and 41*c*) and an indoor unit side refrigerant circuit 42 (42*a*, 42*b*, and 42*c*), in which different kinds of refrigerants circulate as described below, are configured, and an intermediate heat exchanger 40 (40*a*, 40*b*, and 40*c*) is interposed between the two refrigerant circuits 41 and 42. This means that the branch pipes 22*a*, 22*b*, and 22*c* and the branch pipes 21*a*, 21*b*, and 21*c* are connected with each other such that the refrigerant circulates the outdoor unit 101 and the intermediate heat exchanger 40 (40*a*, 40*b*, and 40*c*) of the relay unit 102 connected with the outdoor unit 101 by the first connection pipe 21 and the second connection pipe 22, to form the closed refrigerant circuits 41*a*, 41*b*, and 41*c*. Then, the refrigerant circuits 41*a*, 41*b*, and 41*c* are provided with first flow rate control devices 110*a*, 110*b*, and 110*c*, respectively.

Meanwhile, the refrigerant circuits 42*a*, 42*b*, and 42*c* are configured to be closed such that refrigerant (water or antifreeze, for example) other than the above-described refrigerant circulates the indoor heat exchangers 1000*a*, 1000*b*, and 1000*c* of the indoor units 103*a*, 103*b*, and 103*c* and the intermediate heat exchangers 40 (40*a*, 40*b*, and 40*c*) of the relay unit 102. The refrigerant circuits 42*a*, 42*b*, and 42*c* are provided with pumps 43*a*, 43*b*, and 43*c*, and the intermediate heat exchangers 40*a*, 40*b*, and 40*c* are interposed between the relay unit side refrigerant circuits 41*a*, 41*b*, and 41*c* and the indoor unit side refrigerant circuits 42*a*, 42*b*, and 42*c*, to allow the refrigerant flowing in the refrigerant circuit 41 and the refrigerant flowing in the refrigerant circuit 42 to exchange heat with each other by the intermediate heat exchanger 40. The other functions and configurations are the same as those of Embodiment 6.

As described above, even when different kinds of refrigerants flow in the relay unit side refrigerant circuit 41 and the indoor unit side refrigerant circuit 42, the same effect as that of Embodiment 6 can be achieved.

Embodiment 8

In Embodiment 6 and Embodiment 7, the third gas-liquid separator 140 is provided to the outdoor unit 101. However, the third gas-liquid separator 140 may be provided to the relay unit 102. In the below description, an example in which the installment position of the third gas-liquid separator 140 is changed in the multi-split type air-conditioning apparatus 10000 shown in Embodiment 6 will be given.

Figure 16:
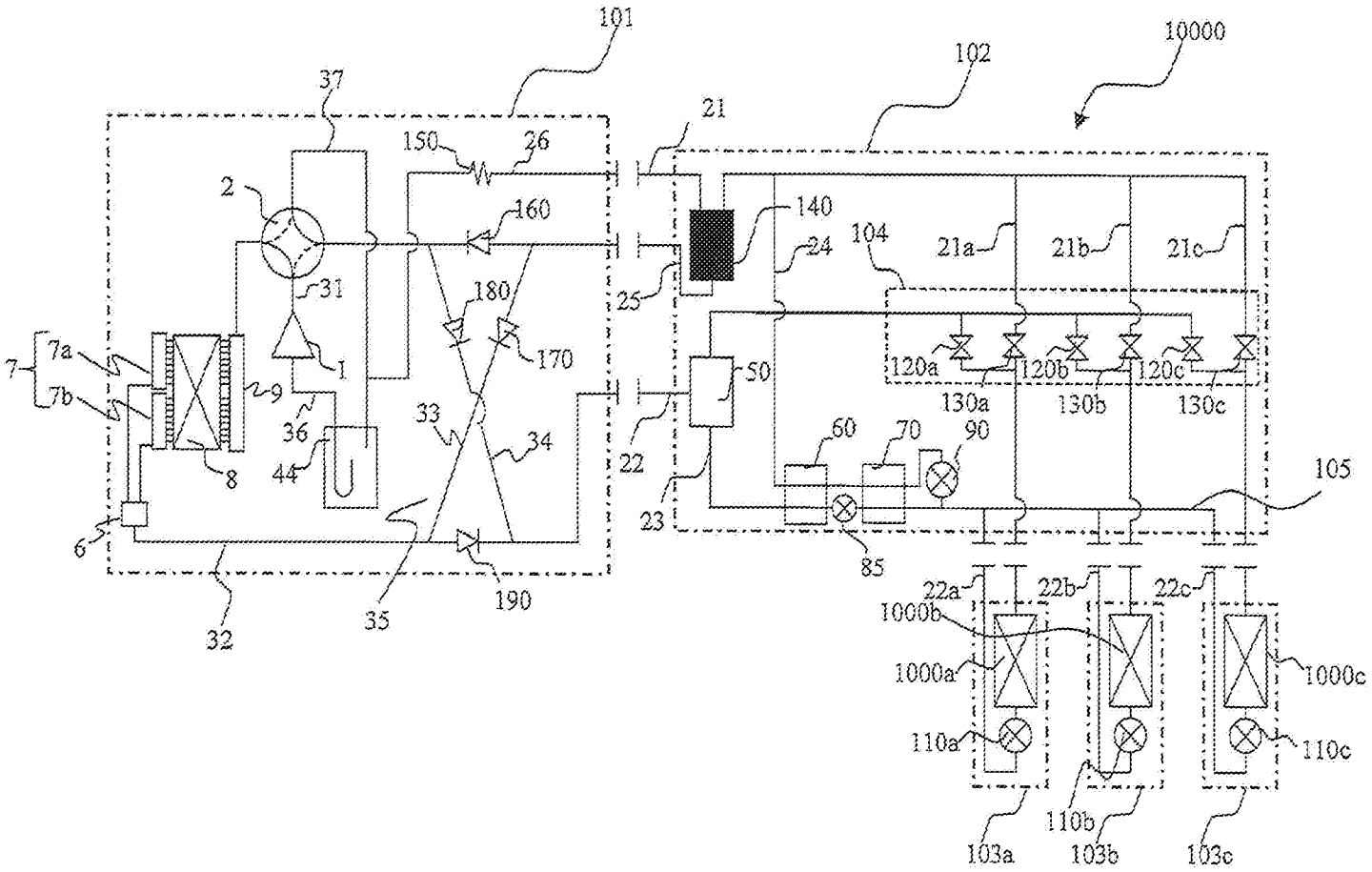
FIG. 16 is a refrigerant circuit diagram illustrating an exemplary refrigerant circuit configuration of a multi-split type air-conditioning apparatus according to Embodiment 8 of the present invention.

FIG. 16 is a refrigerant circuit diagram illustrating an example of a refrigerant circuit configuration of a multi-split type air-conditioning apparatus according to Embodiment 8 of the present invention.

In Embodiment 8, the third gas-liquid separator 140 is connected to the middle of the first connection pipe 21, and the third gas-liquid separator 140 is installed in the relay unit 102. By installing the third gas-liquid separator 140 in the relay unit 102 in this way, as gas refrigerant or liquid refrigerant, in which gas and liquid are separated, flows in the first connection pipe 21, it is possible to significantly reduce a pressure loss caused by the extension pipe between the outdoor unit 101 and the relay unit 102. The other functions and configurations are the same as those of Embodiment 6 and Embodiment 7.

Embodiment 9

(Zeotropic Refrigerant Mixture)

Regarding the refrigerant flowing in the outdoor units 100 and 101 described above, in the case of using zeotropic refrigerant mixture (for example, R404A, R407C, or the like) rather than single refrigerant (for example, R22 or the like) or azeotropic refrigerant mixture (for example, R502, R507A, or the like), gas refrigerant in which gas and liquid are separated, having a lower boiling point in the zeotropic refrigerant mixture, is allowed to bypass as gas refrigerant by the third gas-liquid separator 140, and liquid refrigerant, in which gas and liquid are separated, flows out as a zeotropic refrigerant mixture in which composition ratio is biased to refrigerant having a high boiling point with the inlet of the third gas-liquid separator 140. As such, in addition to the effect of reducing a pressure loss in the outdoor heat exchanger 8, there is an effect of mitigating temperature gradient (temperature glide) in a two-phase state that causes deterioration of performance of the zeotropic refrigerant mixture. The other functions and configurations are the same as Embodiments 1 to 8.

Embodiment 10

In Embodiments 1 to 9, details of a connection configuration between the liquid header portion and the outdoor heat exchanger 8 (in more detail, heat transfer tube 15) are not described particularly. By connecting the liquid header portion and the outdoor heat exchanger 8 as described below, it is possible to allow refrigerant to flow in a larger amount to the liquid header portion connected with a divided region of the outdoor heat exchanger 8 in which distribution of the wind speed is largely biased. It should be noted that the configurations not described in Embodiment 10 are the same as those in any of Embodiments 1 to 9, and the configurations that are the same as those of the above-described embodiments are denoted by the same reference numerals.

Figure 17:
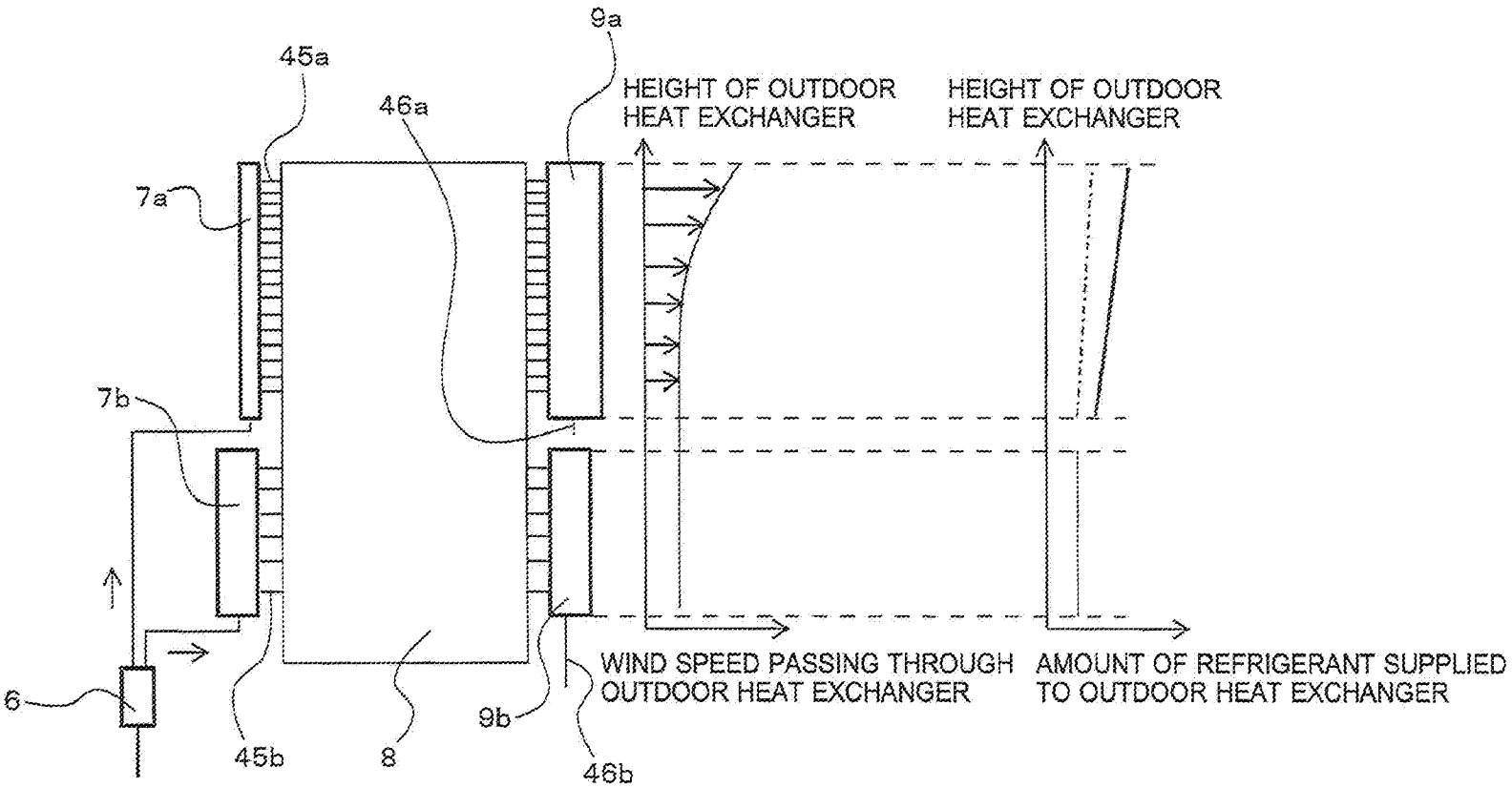
FIG. 17 illustrates an outdoor heat exchanger of an air-conditioning apparatus according to Embodiment 10 of the present invention.

FIG. 17 illustrates an outdoor heat exchanger of an air-conditioning apparatus according to Embodiment 10 of the present invention. It should be noted that in FIG. 17, distribution of the wind speed passing through the outdoor heat exchanger 8 and the amount of refrigerant (refrigerant distribution) supplied to the outdoor heat exchanger 8 are also shown.

In Embodiment 10, respective liquid header portions 7*a* and 7*b* and the heat transfer tubes 15 of the outdoor heat exchanger 8 are connected by a plurality of branch pipes 45. In detail, the liquid header portion 7*a* arranged in an upper portion (connected with the heat transfer tubes 15 of a divided region having larger distribution of wind speed) is connected with the heat transfer tubes 15 of the outdoor heat exchanger 8 by the branch pipes 45*a*. Further, the liquid header portion 7*b* arranged in a lower portion (connected with the heat transfer tubes 15 of a divided region having a smaller distribution of wind speed) is connected with the heat transfer tubes 15 of the outdoor heat exchanger 8 by the branch pipes 45*b*. Compared with the liquid header portion 7*b* arranged in the lower portion, the liquid header portion 7*a* arranged in the upper portion has a configuration in which a larger number of branch pipes 45 are connected to a region of the same area. In other words, considering the number of each of the branch pipes 45*a* and 45*b* connected to a region of the same size, the number of the branch pipes 45*a* is larger than the number of the branch pipes 45*b*.

It should be noted that in Embodiment 10, when the outdoor heat exchanger 8 functions as an evaporator, the gas header 9 connected to a position which is a refrigerant outflow side of the outdoor heat exchanger 8 is divided into a plurality of gas header portions in the up and down direction. In FIG. 17, the gas header 9 is divided into two gas header portions 9*a* and 9*b* in the up and down direction. Further, the gas header portions 9*a* and 9*b* are connected with the four-way valve 2 by a refrigerant outlet pipe 46. In detail, the gas header portion 9*a* is connected with the four-way valve 2 by a refrigerant outlet pipe 46*a*. Further, the gas header portion 9*b* is connected with the four-way valve 2 by a refrigerant outlet pipe 46*b*. This means that the refrigerant outlet pipe 46 (refrigerant outlet pipes 46*a* and 46*b*) connects the gas header 9 (gas header portions 9*a* and 9*b*) and the suction side of the compressor 1, when the outdoor heat exchanger 8 functions as an evaporator.

As described above, in Embodiment 10, compared with the liquid header portion 7*b* arranged in the lower portion, the liquid header portion 7*a* arranged in the upper portion has a configuration in which a larger number of branch pipes 45 are connected to a region of the same area. As such, the flow resistance of the refrigerant, flowing into the heat transfer tube 15 of a divided region having larger distribution of the wind speed, is smaller. Accordingly, a larger amount of refrigerant can be supplied to a divided region having larger wind speed distribution. As such, by connecting the liquid header portions 7*a* and 7*b* and the outdoor heat exchanger 8 as Embodiment 10, largely biased wind speed distribution can be managed.

Embodiment 11

In the configurations of Embodiments 1 to 10, by configuring the gas header 9 as described below, it is possible to supply a larger amount of refrigerant to a divided region having larger wind speed distribution. It should be noted that the configurations not described in Embodiment 11 are the same as those in any of Embodiments 1 to 10, and the configurations that are the same as those of the above-described embodiments are denoted by the same reference numerals.

Figure 18:
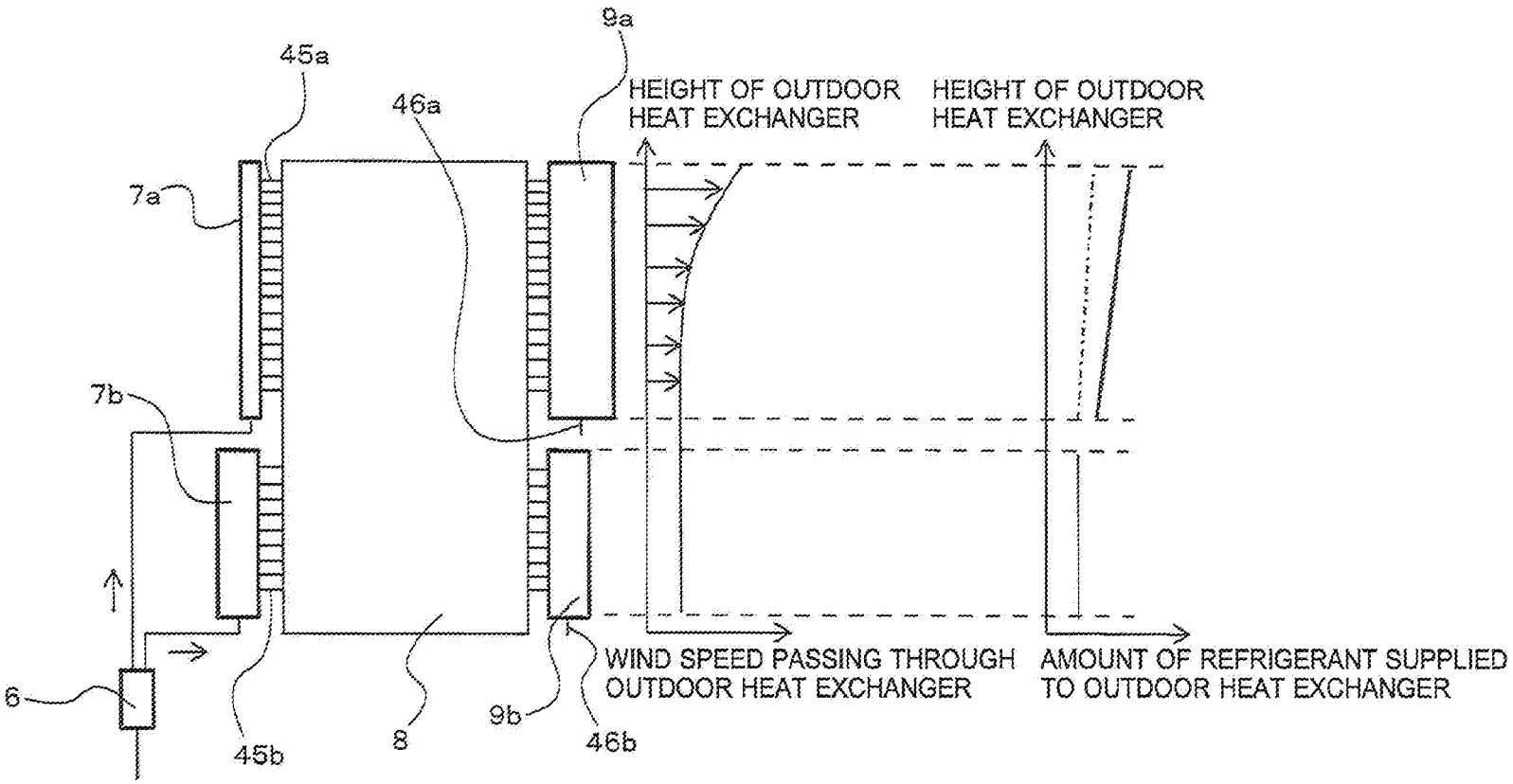
FIG. 18 illustrates an outdoor heat exchanger of an air-conditioning apparatus according to Embodiment 11 of the present invention.

FIG. 18 illustrates an outdoor heat exchanger of an air-conditioning apparatus according to Embodiment 11 of the present invention. It should be noted that FIG. 18 also illustrates distribution of the wind speed passing through the outdoor heat exchanger 8 and the amount of refrigerant (refrigerant distribution) supplied to the outdoor heat exchanger 8.

In Embodiment 11, the gas header 9 is divided into a plurality of gas header portions in the up and down direction. In FIG. 18, the gas header 9 is divided into two gas header portions 9*a* and 9*b* in the up and down direction. The inner diameter of the gas header portion 9*a* arranged in an upper portion (connected with the heat transfer tubes 15 of a divided region having larger wind speed distribution) is larger than the inner diameter of the gas header portion 9*b* arranged in a lower portion (connected with the heat transfer tubes 15 of a divided region of smaller wind speed distribution). As such, as the flow resistance in the gas header portion 9*a* is decreased, a larger amount of refrigerant can be supplied to the divided region having larger wind speed distribution. This means that by configuring the gas header 9 as Embodiment 11, a larger amount of refrigerant can be supplied to a divided region having larger wind speed distribution, whereby larger bias of the wind speed can be handled.

Embodiment 12

In the configurations of Embodiments 1 to 11, even by configuring the gas header 9 as described below, it is possible to supply a larger amount of refrigerant to a divided region having larger wind speed distribution. It should be noted that the configurations not described in Embodiment 12 are the same as those in any of Embodiments 1 to 11, and the configurations that are the same as those of the above-described embodiments are denoted by the same reference numerals.

Figure 19:
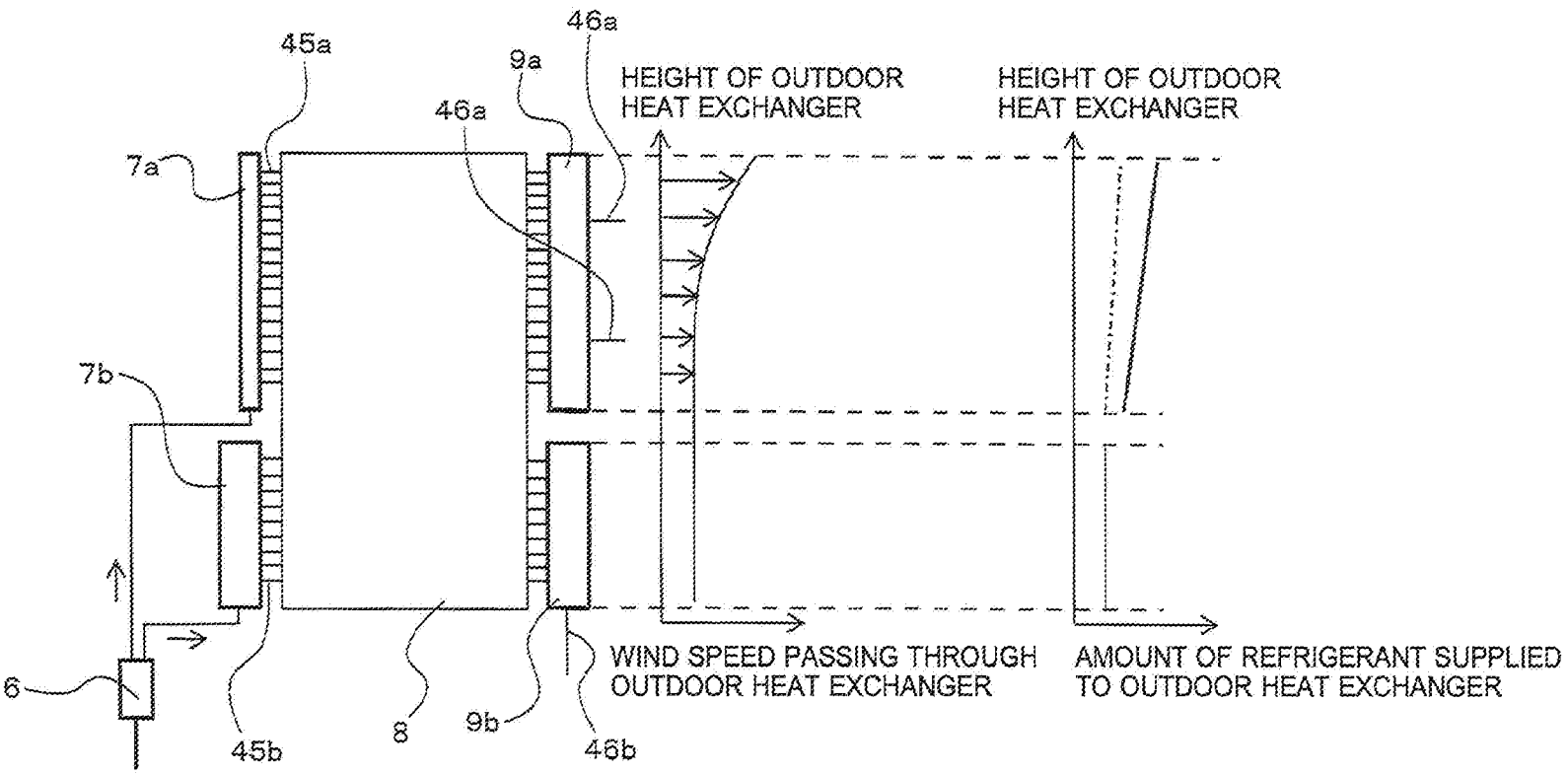
FIG. 19 illustrates an outdoor heat exchanger of an air-conditioning apparatus according to Embodiment 12 of the present invention.

FIG. 19 illustrates an outdoor heat exchanger of an air-conditioning apparatus according to Embodiment 12 of the present invention. It should be noted that in FIG. 19, distribution of the wind speed passing through the outdoor heat exchanger 8 and the amount of refrigerant (refrigerant distribution) supplied to the outdoor heat exchanger 8 are also shown.

In Embodiment 12, the gas header 9 is divided into a plurality of gas header portions in the up and down direction. In FIG. 19, the gas header 9 is divided into two gas header portions 9*a* and 9*b* in the up and down direction. To the gas header portion 9*a* arranged in an upper portion (connected with the heat transfer tubes 15 of a divided region having larger wind speed distribution), a larger number of refrigerant outlet pipes 46 are connected, compared with that of the gas header portion 9*b* arranged in a lower portion (connected with the heat transfer tubes 15 of a divided region having smaller wind speed distribution). In FIG. 19, to the gas header portion 9*a* arranged in the upper portion, two refrigerant outlet pipes 46*a* are connected, and to the gas header portion 9*b* arranged in the lower portion, one refrigerant outlet pipe 46*b* is connected. As such, as the flow resistance in the gas header portion 9*a* is decreased, a larger amount of refrigerant can be supplied to a divided region having larger wind speed distribution. This means that by configuring the gas header 9 as Embodiment 12, a larger amount of refrigerant can be supplied to a divided region having larger wind speed distribution, whereby larger bias of the wind speed distribution can be handled.

REFERENCE SIGNS LIST

1 compressor 2 four-way valve 3 indoor heat exchanger 4 expansion valve 5 first gas-liquid separator 6 shunt 6*a* main body unit

6*b* connection pipe 7 liquid header 7*a* to 7*c* liquid header portion 8 outdoor heat exchanger 8*a* outdoor heat exchanger 9 gas header 9*a*,9*b* gas header portion 10 bypass 10*a* first bypass pipe 11 flow rate control mechanism 12 fan 13 casing 14 orifice 15 heat transfer tube 16 fin

20 controller 21 first connection pipe 21*a* to 21*c* branch pipe 22 second connection pipe 22*a* to 22*c* branch pipe 23 second bypass pipe 24 third bypass pipe 25 liquid side outlet pipe 26 gas side outlet pipe 31 discharge pipe 32 refrigerant pipe 33,34 short circuit pipe 35 flow channel switching circuit 36 suction pipe 37 refrigerant pipe 40 (40*a* to 40*c*) intermediate heat exchanger 41 (41*a* to 41*c*) relay unit side refrigerant circuit 42 (42*a* to 42*c*) indoor unit side refrigerant circuit 43*a* to 43*c* pump 44 accumulator 45 (45*a*,45*b*) branch pipe 46 (46*a*,46*b*) refrigerant outlet pipe 50 second gas-liquid separator 60 first heat exchanger 70 second heat exchanger 85 third flow rate control device 90 second flow rate control device 100 outdoor unit 101 outdoor unit 102 relay unit 103 (103*a* to 103*c*) indoor unit 104 switching unit 105 second branch portion

110*a* to 110*c* first flow rate control device 120*a* to 120*c* solenoid valve

130*a* to 130*c* solenoid valve 140 third gas-liquid separator 150 gas side bypass resistance 160 to 190 check valve 200 indoor unit 300 air-conditioning apparatus 1000*a* to 1000*c* indoor heat exchanger 10000 multi-split type air-conditioning apparatus.

The invention claimed is:

1. An air-conditioning apparatus comprising:

a refrigeration cycle including a compressor, an indoor heat exchanger serving as a condenser or an evaporator, an expansion valve, an outdoor heat exchanger serving as an evaporator or a condenser in which gas refrigerant is cooled to liquid refrigerant, and a liquid header connected to a position that is a refrigerant inflow side of the outdoor heat exchanger when the outdoor heat exchanger serves as the evaporator;

an outdoor fan configured to supply air to the outdoor heat exchanger, the outdoor heat exchanger being provided to a casing of an outdoor unit such that heat transfer tubes are arranged in parallel in an up and down direction, the air, sucked into the casing of the outdoor unit by the outdoor fan, being discharged from an upper portion of the casing after exchanging heat in the outdoor heat exchanger, the liquid header being divided into a plurality of liquid header portions in the up and down direction, the plurality of the liquid header portions include a first liquid header portion and a second liquid header portion arranged below the first liquid header portion, each of the liquid header portions being configured to be connected with each of the heat transfer tubes of divided regions formed by dividing the outdoor heat exchanger in the up and down direction, a first gas-liquid separator configured to separate two-phase refrigerant, flowing out of the expansion valve, into gas refrigerant and liquid refrigerant;

a bypass connecting the first gas-liquid separator and a suction side of the compressor, the bypass being configured to adjust an amount of the gas refrigerant, separated by the first gas-liquid separator, to be returned to the suction side of the compressor; and a shunt connecting the first gas-liquid separator and each of the liquid header portions and configured to supply the two-phase refrigerant, in which quality is adjusted by the first gas-liquid separator, to each of the liquid header portions, the shunt being configured to supply, to each of the first and second liquid header portions, the two-phase refrigerant of an amount corresponding to an air quantity of the divided region connected with each of the liquid header portions, wherein an amount of two-phase refrigerant supplied from the first liquid header portion to one of the heat transfer tubes connected to the first liquid header portion is greater than an amount of two-phase refrigerant supplied from the second liquid header portion to one of the heat transfer tubes connected to the second liquid header portion, and wherein the shunt is configured such that, when the outdoor heat exchanger serves as a condenser, liquid refrigerants which flow out from each of the plurality of liquid header portions are combined and the combined refrigerant flows into the first gas-liquid separator.

2. The air-conditioning apparatus of claim 1, wherein an inner diameter value D of the first liquid header portion is less than an inner diameter value for the first liquid header portion where refrigerant mass flux of the first liquid header portion is a same as a refrigerant mass flux of the second liquid header portion.

3. The air-conditioning apparatus of claim 1, wherein an inner diameter of one of the liquid header portions connected with a heat transfer tube of the heat transfer tubes in one of the divided regions, in which wind speed distribution is more biased, is smaller than an inner diameter of another one of the liquid header portions connected with a heat transfer tube of the heat transfer tubes in an other one of the divided regions in which wind speed distribution is less biased than the wind speed distribution of the one of the divided regions.

4. The air-conditioning apparatus of claim 1, wherein as an inner diameter of a flow channel of the shunt connected with each of the liquid header portions is formed to be different for each of the liquid header portions, the shunt changes the amount of the two-phase refrigerant supplied to each of the liquid header portions.

5. The air-conditioning apparatus of claim 1, wherein as a length of a flow channel of the shunt connected with the each of the liquid header portions is formed to be different for each of the liquid header portions, the shunt changes the amount of the two-phase refrigerant supplied to each of the liquid header portions.

6. The air-conditioning apparatus of claim 1, further comprising:

a first bypass pipe and a flow rate control mechanism constituting the bypass, the first bypass pipe connecting the first gas-liquid separator and the suction side of the compressor and allowing the gas refrigerant separated by the first gas-liquid separator to return to the suction side of the compressor, the flow rate control mechanism adjusting a flow rate of the gas refrigerant flowing in the first bypass pipe; and a controller configured to control the air quantity of the outdoor fan and an opening degree of the flow rate control mechanism, wherein the controller decreases the opening degree of the flow rate control mechanism when increasing the air quantity of the outdoor fan, and increases the opening degree of the flow rate control mechanism when decreasing the air quantity of the outdoor fan.

7. The air-conditioning apparatus of claim 1, wherein the refrigerant flowing in the outdoor unit is a zeotropic refrigerant mixture.

8. The air-conditioning apparatus of claim 1, further comprising a plurality of branch pipes connecting the respective liquid header portions and the heat transfer tubes of the outdoor heat exchanger, wherein the liquid header portion connected with the divided region in which wind speed distribution is more biased has a larger number of the branch pipes connected with a region of a same size, compared with the liquid header portion connected with the divided region in which wind speed distribution is less biased.

9. The air-conditioning apparatus of claim 1, further comprising a gas header connected to a position that is a refrigerant outflow side of the outdoor heat exchanger when the outdoor heat exchanger serves as an evaporator, wherein the gas header is divided into a plurality of gas header portions in the up and down direction, an inner diameter of a gas header portion of the plurality of gas header portions connected with a heat transfer tube of the heat transfer tubes of one of the divided regions, in which wind speed distribution is more biased, is larger than an inner diameter of a gas header portion of the plurality of gas header portions connected with a heat transfer tube of the heat transfer tubes of an other one of the divided regions in which wind speed distribution is less biased than the wind speed distribution of the one of the divided regions.

10. The air-conditioning apparatus of claim 1, further comprising:

a gas header connected to a position that is a refrigerant outlet side of the outdoor heat exchanger when the outdoor heat exchanger serves as an evaporator; and a plurality of refrigerant outlet pipes connecting the gas header and the suction side of the compressor when the outdoor heat exchanger serves as the evaporator, wherein the gas header is divided into a plurality of gas header portions in the up and down direction, and a gas header portion of the plurality of gas header portions connected with a heat transfer tube of the heat transfer tubes of one of the divided regions, in which wind speed distribution is more biased, has a larger number of the refrigerant outlet pipes, compared with a gas header portion of the plurality of gas header portions connected with a heat transfer tube of the heat transfer tubes of an other one of the divided regions in which wind speed distribution is less biased than the wind speed distribution of the one of the divided regions.

11. The air-conditioning apparatus of claim 1, further comprising:

a gas header connected to a position that is a refrigerant outlet side of the outdoor heat exchanger when the outdoor heat exchanger serves as an evaporator; and a plurality of refrigerant outlet pipes connecting the gas header and the suction side of the compressor when the outdoor heat exchanger serves as an evaporator;

wherein the liquid header is divided into a plurality of liquid header portions such that each of the plurality of liquid header portions is independently formed as a pipe which extends in the up and down direction, wherein the gas header is divided into a plurality of gas header portions such that each of the plurality of gas header portions is independently formed as a pipe which extends in the up and down direction, wherein a gas header portion of the plurality of gas header portions is connected with a heat transfer tube of the heat transfer tubes of one of the divided regions in which wind speed distribution is less biased than the wind speed distribution of an other of the divided regions, and wherein a refrigerant outlet pipe of the plurality of refrigerant outlet pipes is connected to the gas header portion at an underside of the heat transfer tube.

12. The air-conditioning apparatus of claim 1, further comprising:

the outdoor unit including at least the compressor, a four-way valve, the liquid header divided into the plurality of the liquid header portions in the up and down direction, the shunt, the outdoor heat exchanger, and the outdoor fan;

a relay unit connected with the outdoor unit by a first connection pipe and a second connection pipe;

a plurality of indoor units each having at least an indoor heat exchanger, the indoor units being connected with the relay unit in parallel with each other, the outdoor unit including a first path guiding the refrigerant, discharged from the compressor, to the second connection pipe via the four-way valve, the liquid header, and the outdoor heat exchanger, in accordance with respective operation modes including cooling, heating, cooling main, and heating main, and a second path guiding the refrigerant to the second connection pipe via the four-way valve without passing the liquid header and the outdoor heat exchanger, the relay unit including a second gas-liquid separator connected to a middle of the second connection pipe, a switching unit configured to selectively connect each of the indoor units and one of the first connection pipe and the second connection pipe, a second bypass pipe connecting the second gas-liquid separator and each of the indoor units, a third bypass pipe connecting the first connection pipe and the second bypass pipe, and a bypass pipe flow rate control device interposed in the third bypass pipe and serving as the expansion valve, a third gas-liquid separator connected with the first connection pipe, and serving as the first gas-liquid separator in a heating operation mode and a heating main operation mode;

a gas side outlet pipe and a flow rate control mechanism connecting the third gas-liquid separator and the suction side of the compressor, and serving as the bypass in the heating operation mode and the heating main operation mode; and a third path for supplying two-phase refrigerant, in which quality is adjusted by the third gas-liquid separator, to the shunt in the heating operation mode and the heating main operation mode.

13. The air-conditioning apparatus of claim 12, wherein the third gas-liquid separator is provided to the relay unit.

14. The air-conditioning apparatus of claim 12, wherein the plurality of indoor units each include a corresponding indoor heat exchanger serving as the condenser when the indoor unit performs heating, and a corresponding first flow rate control device serving as the expansion valve.

15. The air-conditioning apparatus of claim 12, wherein the relay unit includes a plurality of intermediate heat exchangers each serving as the condenser when the indoor unit performs heating, and a plurality of first flow rate control devices each connected with each of the intermediate heat exchangers and serving as the expansion valve, the plurality of indoor units each include a corresponding indoor heat exchanger connected with the intermediate heat exchangers, a first refrigerant circuit that is closed is configured to allow a first refrigerant to flow in the outdoor unit and the intermediate heat exchangers of the relay unit, and a second refrigerant circuit that is closed is configured to allow a second refrigerant to flow in the plurality of indoor units and the intermediate heat exchanger of the relay unit.

16. An air-conditioning apparatus comprising:

a refrigeration cycle including a compressor, an indoor heat exchanger serving as a condenser or an evaporator, an expansion valve, an outdoor heat exchanger serving as an evaporator or a condenser in which gas refrigerant is cooled to liquid refrigerant, and a liquid header connected to a position that is a refrigerant inflow side of the outdoor heat exchanger when the outdoor heat exchanger serves as the evaporator;

an outdoor fan configured to supply air to the outdoor heat exchanger, the outdoor heat exchanger being provided to a casing of an outdoor unit such that heat transfer tubes are arranged in parallel in an up and down direction, the air, sucked into the casing of the outdoor unit by the outdoor fan, being discharged from an upper portion of the casing after exchanging heat in the outdoor heat exchanger, the liquid header being divided into a plurality of liquid header portions in the up and down direction, the plurality of the liquid header portions include a first liquid header portion and a second liquid header portion arranged below the first liquid header portion, each of the liquid header portions being configured to be connected with each of the heat transfer tubes of divided regions formed by dividing the outdoor heat exchanger in the up and down direction, a first gas-liquid separator configured to separate two-phase refrigerant, flowing out of the expansion valve, into gas refrigerant and liquid refrigerant;

a bypass connecting the first gas-liquid separator and a suction side of the compressor, the bypass being configured to adjust an amount of the gas refrigerant, separated by the first gas-liquid separator, to be returned to the suction side of the compressor; and a shunt connecting the first gas-liquid separator and each of the liquid header portions and configured to supply the two-phase refrigerant, in which quality is adjusted by the first gas-liquid separator, to each of the liquid header portions, the shunt being configured to supply, to each of the first and second liquid header portions, the two-phase refrigerant of an amount corresponding to an air quantity of the divided region connected with each of the liquid header portions, wherein a first average flow rate of two-phase refrigerant supplied from the first liquid header portion to the heat transfer tubes connected to the first liquid header portion is greater than a second average flow rate of two-phase refrigerant supplied from the second liquid header portion to the heat transfer tubes connected to the second liquid header portion, the first average flow rate has a value equal to dividing a flow rate of two-phase refrigerant supplied to the first liquid header portion by the number of the heat transfer tubes connected to the first liquid header portion, and the second average flow rate has a value equal to dividing a flow rate of two-phase refrigerant supplied to the second liquid header portion by the number of the heat transfer tubes connected to the second liquid header portion, and wherein the shunt is configured such that, when the outdoor heat exchanger serves as a condenser, liquid refrigerants which flow out from each of the plurality of liquid header portions are combined and the combined refrigerant flows into the first gas-liquid separator.

* * * * *